US011293194B2

(12) United States Patent
Chevis

(10) Patent No.: US 11,293,194 B2
(45) Date of Patent: Apr. 5, 2022

(54) MODULAR LEDGERS OF AN INTEGRATED CONSTRUCTION SYSTEM

(71) Applicant: Apache Industrial Services, Inc., Houston, TX (US)

(72) Inventor: Kenneth M. Chevis, Metairie, LA (US)

(73) Assignee: Apache Industrial Services, INC, Houston, TX (US)

( * ) Notice: Subject to any disclaimer, the term of this patent is extended or adjusted under 35 U.S.C. 154(b) by 0 days.

(21) Appl. No.: 16/572,552

(22) Filed: Sep. 16, 2019

(65) Prior Publication Data

US 2020/0011074 A1 Jan. 9, 2020

Related U.S. Application Data

(63) Continuation of application No. 15/910,698, filed on Mar. 2, 2018, now Pat. No. 10,415,262, which is a (Continued)

(51) Int. Cl.

| | |
|---|---|
| ***E04G 21/32*** | (2006.01) |
| ***E04G 17/00*** | (2006.01) |
| ***E04C 3/04*** | (2006.01) |
| ***E04G 11/06*** | (2006.01) |
| ***E04G 17/14*** | (2006.01) |

(Continued)

(52) U.S. Cl.

CPC ..... *E04G 21/3242* (2013.01); *E04G 11/06* (2013.01); *E04G 17/002* (2013.01); *E04G 17/14* (2013.01); *E04C 2003/0452* (2013.01); *E04C 2003/0465* (2013.01); *E04C 2003/0491* (2013.01); *E04G 11/28* (2013.01); *E04G 11/50* (2013.01); *E04G 25/065* (2013.01); (Continued)

(58) Field of Classification Search

CPC ... E04G 21/3242; E04G 11/28; E04G 25/065; E04G 11/50; E04G 17/002; E04G 17/14; E04G 11/06; E04G 2011/505; E04G 2025/003; E04G 2011/067; E04C 2003/0452; E04C 2003/0465; E04C 2003/0491

USPC ..... 182/113

See application file for complete search history.

(56) References Cited

U.S. PATENT DOCUMENTS 2,261,907 A 11/1941 Uecker et al.
2,479,962 A 8/1949 Paulson
(Continued)

FOREIGN PATENT DOCUMENTS

BE 1006369 A6 8/1994
CH 506685 A 4/1971
(Continued)

OTHER PUBLICATIONS

PCT International Search Report and Written Opinion; PCT/US2021/020113; dated Aug. 4, 2021.

*Primary Examiner* — Andrew J Triggs
(74) *Attorney, Agent, or Firm* — Pramudji Law Group PLLC; Ari Pramudji

(57) ABSTRACT

Various implementations described herein are directed to a modular ledger of an integrated construction system. In one implementation, the modular ledger includes a rail, having a first end and a second end. Each end of the rail is configured to receive a coupling component. The rail has a plurality of holes configured to couple to bracing components of the integrated construction system.

20 Claims, 28 Drawing Sheets

Related U.S. Application Data continuation-in-part of application No. 15/845,926, filed on Dec. 18, 2017, now Pat. No. 10,465,399, which is a continuation-in-part of application No. 15/630,923, filed on Jun. 22, 2017, now Pat. No. 10,472,823.

(60) Provisional application No. 62/471,173, filed on Mar. 14, 2017, provisional application No. 62/354,325, filed on Jun. 24, 2016.

(51) Int. Cl.

| | |
|---|---|
| *E04G 11/28* | (2006.01) |
| *E04G 25/06* | (2006.01) |
| *E04G 11/50* | (2006.01) |
| *E04G 25/00* | (2006.01) |

(52) U.S. Cl.

CPC .. *E04G 2011/067* (2013.01); *E04G 2011/505* (2013.01); *E04G 2025/003* (2013.01)

(56) References Cited

U.S. PATENT DOCUMENTS

| | | | | |
|---|---|---|---|---|
| 2,573,806 | A | 11/1951 | Paterson | |
| 2,970,677 | A | 2/1961 | Springs, Jr. et al. | |
| 3,018,898 | A | 1/1962 | Frazelle | |
| 3,318,057 | A | 5/1967 | Norsworthy | |
| 3,392,801 | A | 7/1968 | Gethrmann | |
| 3,420,012 | A | 1/1969 | Liskey, Jr. et al. | |
| 3,486,287 | A | 12/1969 | Guillon | |
| 3,493,208 | A | 2/1970 | Sato | |
| 3,533,857 | A | 10/1970 | Mayer et al. | |
| 3,550,723 | A * | 12/1970 | Gentry | E01D 21/00 182/36 |
| 3,601,356 | A | 8/1971 | Yurick et al. | |
| 3,684,058 | A | 8/1972 | Brown | |
| 3,696,578 | A | 10/1972 | Swensen et al. | |
| 3,822,850 | A | 7/1974 | Elias | |
| 4,030,694 | A | 6/1977 | Schimmel | |
| 4,032,100 | A | 6/1977 | Kahn | |
| 4,033,081 | A | 7/1977 | Perkins, Jr. | |
| 4,158,452 | A | 6/1979 | Gates | |
| 4,372,425 | A | 2/1983 | Murphy | |
| 4,458,461 | A | 7/1984 | Holley | |
| 4,470,574 | A | 9/1984 | Jackson | |
| 4,493,172 | A | 1/1985 | Jones | |
| 4,558,544 | A | 12/1985 | Albrecht et al. | |
| 4,787,183 | A | 11/1988 | Johnston | |
| 4,821,844 | A | 4/1989 | Huffman et al. | |
| 4,831,791 | A | 5/1989 | Ball | |
| 4,880,195 | A | 11/1989 | Lepley | |
| 4,919,268 | A | 4/1990 | Young et al. | |
| 5,240,089 | A | 8/1993 | Spera | |
| 5,307,601 | A * | 5/1994 | McCracken | E04C 3/07 52/364 |
| 5,379,566 | A | 1/1995 | Schwörer | |
| 5,385,323 | A | 1/1995 | Garelick | |
| 5,447,249 | A | 9/1995 | Vickers | |
| 5,509,635 | A | 4/1996 | Jaruzel | |
| 5,575,938 | A | 11/1996 | Ono | |
| 5,791,096 | A | 8/1998 | Chen | |
| 5,941,486 | A | 8/1999 | Riblet | |
| 5,979,119 | A | 11/1999 | Trafton | |
| 6,059,258 | A | 5/2000 | Jackson | |
| 6,186,856 | B1 | 2/2001 | Chen | |
| 6,422,345 | B1 | 7/2002 | Schwörer | |
| 6,439,344 | B1 | 8/2002 | Cole | |
| 6,450,291 | B1 | 9/2002 | Ono | |
| 6,520,471 | B2 | 2/2003 | Jones et al. | |
| 6,554,235 | B1 | 4/2003 | Fortier | |
| 6,575,652 | B2 | 6/2003 | Krauss | |
| 6,751,914 | B2 | 6/2004 | Zeh et al. | |
| 6,872,117 | B1 | 3/2005 | Chen | |
| 6,913,422 | B2 | 7/2005 | Rogers | |
| 6,953,106 | B2 | 10/2005 | Weston et al. | |
| 7,032,268 | B2 * | 4/2006 | Jackson | E01D 21/00 14/78 |
| 7,165,361 | B2 | 1/2007 | Vanagan | |
| 7,249,624 | B2 | 7/2007 | Zeh et al. | |
| 7,530,540 | B2 | 5/2009 | Long et al. | |
| 7,918,059 | B2 | 4/2011 | Repasky | |
| 8,083,192 | B2 | 12/2011 | Wells et al. | |
| 8,302,356 | B2 | 11/2012 | Knight, III et al. | |
| 8,403,280 | B2 | 3/2013 | Halverson et al. | |
| 8,418,425 | B1 * | 4/2013 | Santini | E04H 3/28 52/655.1 |
| 8,827,587 | B2 | 9/2014 | Didehvar | |
| 9,546,489 | B2 | 1/2017 | Rosati | |
| 9,556,624 | B1 | 1/2017 | Law | |
| 10,266,993 | B2 | 4/2019 | Szekely | |
| 10,415,262 | B2 * | 9/2019 | Chevis | E04G 11/06 |
| 10,465,399 | B2 * | 11/2019 | Chevis | E04G 17/002 |
| 10,641,302 | B1 | 5/2020 | Huffman et al. | |
| 10,844,613 | B2 | 11/2020 | Repasky et al. | |
| 11,203,470 | B2 | 12/2021 | Ezra et al. | |
| 2002/0185335 | A1 | 12/2002 | Verdyk | |
| 2003/0194265 | A1 | 10/2003 | Krauss | |
| 2005/0166483 | A1 | 8/2005 | Mead | |
| 2006/0175130 | A1 | 8/2006 | Riley | |
| 2007/0045048 | A1 | 3/2007 | Wyse | |
| 2007/0056799 | A1 | 3/2007 | Leidner | |
| 2008/0105172 | A1 | 5/2008 | Repasky | |
| 2008/0141601 | A1 | 6/2008 | Mead | |
| 2008/0244006 | A1 | 10/2008 | Weisner et al. | |
| 2008/0244996 | A1 | 10/2008 | Gillespie et al. | |
| 2009/0188189 | A1 | 8/2009 | Repasky | |
| 2010/0000822 | A1 * | 1/2010 | Wall | E04G 7/26 182/128 |
| 2010/0005735 | A1 | 1/2010 | Gillespie et al. | |
| 2010/0122872 | A1 | 5/2010 | Korevaar | |
| 2011/0138723 | A1 | 6/2011 | Repasky | |
| 2013/0015185 | A1 | 1/2013 | Leal et al. | |
| 2014/0086669 | A1 * | 3/2014 | Rogers | E04G 1/14 403/231 |
| 2014/0339019 | A1 | 11/2014 | Hulett et al. | |
| 2016/0002936 | A1 | 1/2016 | Cox | |
| 2016/0281376 | A1 | 9/2016 | Ward | |
| 2017/0254099 | A1 | 9/2017 | Grumberg et al. | |
| 2017/0350141 | A1 | 12/2017 | Kugler | |
| 2018/0099233 | A1 | 4/2018 | Peiler | |
| 2020/0011074 | A1 * | 1/2020 | Chevis | E04G 11/50 |
| 2021/0180344 | A1 | 6/2021 | McCracken | |

FOREIGN PATENT DOCUMENTS

| | | | |
|---|---|---|---|
| CN | 201835529 | U | 5/2011 |
| CN | 107100358 | A | 8/2017 |
| CN | 207686282 | U | 8/2018 |
| CN | 110700585 | A | 1/2020 |
| CN | 210086830 | U | 2/2020 |
| DE | 9305194 | U1 | 8/1993 |
| DE | 9309950 | U1 | 9/1993 |
| DE | 29912555 | U1 | 10/1999 |
| DE | 10121957 | A1 | 11/2002 |
| EP | 0062420 | A1 | 10/1982 |
| EP | 0369108 | A2 | 5/1990 |
| EP | 0375969 | A1 | 7/1990 |
| EP | 1544379 | A2 | 6/2005 |
| FR | 926917 | A | 10/1947 |
| FR | 2593843 | A | 8/1987 |
| GB | 877463 | A | 9/1961 |
| GB | 2145761 | A | 4/1985 |
| GB | 2215374 | A | 9/1989 |
| GB | 2592433 | A | 9/2021 |
| KR | 920008222 | Y1 | 11/1992 |
| KR | 0134600 | Y1 | 2/1999 |
| KR | 20030095163 | A | 12/2003 |
| KR | 200372312 | Y1 | 1/2005 |
| KR | 200381397 | Y1 | 4/2005 |
| KR | 20060078341 | A | 7/2006 |
| KR | 20110077096 | A | 7/2011 |
| KR | 200469990 | Y1 | 11/2013 |

(56) References Cited

FOREIGN PATENT DOCUMENTS

| | | | |
|---|---|---|---|
| KR | 101335478 | B1 | 12/2013 |
| KR | 20170128688 | A | 11/2017 |
| KR | 20190115612 | A | 10/2019 |
| KR | 102166828 | B1 | 10/2020 |
| KR | 102180857 | B1 | 11/2020 |
| WO | 1998007935 | A1 | 2/1998 |
| WO | 2002003116 | A1 | 1/2002 |
| WO | 2006135223 | A1 | 12/2006 |
| WO | 2017223504 | A1 | 12/2017 |
| WO | 2018143534 | A1 | 8/2018 |

* cited by examiner

MODULAR LEDGERS OF AN INTEGRATED CONSTRUCTION SYSTEM

CROSS-REFERENCE TO RELATED APPLICATIONS

This application is a continuation of U.S. patent application Ser. No. 15/910,698 filed 2018 Mar. 2, which is a continuation-in-part of U.S. patent application Ser. No. 15/845,962 filed 2017 Dec. 18, which is a continuation-in-part of U.S. patent application Ser. No. 15/630,923 filed 2017 Jun. 22, which claims the benefit of U.S. Provisional Application Nos. 62/471,173 filed 2017 Mar. 14 and 62/354,325 filed 2016 Jun. 24, all of which are incorporated herein by reference.

BACKGROUND

This section is intended to provide background information to facilitate a better understanding of various technologies described herein. As the section's title implies, this is a discussion of related art. That such art is related in no way implies that it is prior art. The related art may or may not be prior art. It should therefore be understood that the statements in this section are to be read in this light, and not as admissions of prior art.

There are two types of concrete construction that require some form of formwork: vertical formwork and shoring. Vertical formwork provides the ability to form structures that hold vertical loads. Shoring provides the ability to form structures that hold horizontal loads. Vertical structures like walls, columns and foundations require formwork, and horizontal structures like slabs, beams and girders require shoring to cast them into place as an elevated structural component. Examples where shoring provides horizontal concrete members include: slabs, horizontal concrete girders, cross-t's under highways, etc.

Many companies in existence today have developed specific independent formwork systems and independent shoring systems. They generally carry a sizable inventory of several different types that are both rented and sold to contractors who build concrete structures.

The applications of formwork and shoring are unlimited given the wide range of project types in both the industrial and commercial construction markets. From high-rise buildings, to the construction of an industrial facility, formwork and shoring are used to help contractors cast foundations, columns, walls, elevated slabs and elevated beams in an enormous variety of shapes and uses. Chances are that all of the buildings in which people live and work have some sort of poured in-place concrete that was casted using a formwork system.

Older generation systems required formwork and shoring providers to have significantly large inventories of parts in order to make up the variety of configurations necessary. Those systems consisted of endless amounts of components used by a building contractor. Along with the large amount of inventory items, the assembly efficiency for those systems was often on the low side, as compared to systems in use today. Due to the large amount of pieces, it was common for many of these items to be lost during the construction process.

SUMMARY

Described herein are various implementations of a modular ledger of an integrated construction system. In one implementation, the modular ledger includes a rail, having a first end and a second end. Each end of the rail is configured to receive a coupling component. The rail has a plurality of holes configured to couple to bracing components of the integrated construction system.

The rail may be hollow and constructed of aluminum.

The coupling component may be a ledger clamp, a ledger splice, a ledger guardrail fitting, or a ledger end fitting.

The plurality of holes can be a hole pattern formed longitudinally along each side of the rail.

In one implementation, the rail may be configured to form a wall of a safety deck.

In one implementation, the rail may be configured to form part of a rollback mechanism.

The rail can be configured to form part of a bracing assembly when coupled to the bracing components.

The rail can be configured as a load bearing member when coupled to posts of the integrated construction system.

Described herein are various implementations of a bracing assembly of an integrated construction system. In one implementation, the bracing assembly includes a first rail, a second rail, and a first ledger strut coupled to the first rail and the second rail.

In one implementation, the bracing assembly includes a second ledger strut coupled to the first rail and the second rail. In one implementation, the bracing assembly includes ledger brace members coupled between the first ledger strut and the second ledger strut. The first ledger strut, the second ledger strut, and the ledger brace members may be adjusted along the first rail and the second rail. A distance between the first rail and the second rail may be adjusted by adjusting a lateral position of at least one of the first ledger strut and the second ledger strut along the first rail and the second rail.

In one implementation, the first rail and the second rail may have a first hole pattern. The first ledger strut may have a second hole pattern. The first hole pattern and the second hole pattern may be used to couple the first rail to the second rail via the first ledger strut.

Described herein are various implementations of an integrated construction system component. In one implementation, the integrated construction system component includes a ledger rail. The ledger rail is constructed of aluminum and configured to provide bracing for the integrated construction system and handle vertical loads while attached to other components of the integrated construction system.

The above referenced summary section is provided to introduce a selection of concepts in a simplified form that are further described below in the detailed description section. Additional concepts and various other implementations are also described in the detailed description. The summary is not intended to identify key {XE "Narrowing designation: key"} features or essential {XE "Narrowing designation: essential"} features of the claimed subject matter, nor is it intended to be used to limit the scope of the claimed subject matter, nor is it intended to limit the number of inventions described herein. Furthermore, the claimed subject matter is not limited to implementations that solve any or all {XE "Narrowing designation: all"} disadvantages noted in any part of this disclosure.

BRIEF DESCRIPTION OF THE DRAWINGS

Implementations of various techniques will hereafter be described with reference to the accompanying drawings. It should be understood, however, that the accompanying drawings illustrate only {XE "Narrowing designation.

only"} the various implementations described herein and are not meant to limit the scope of various techniques described herein.

DETAILED DESCRIPTION

Figure 1:
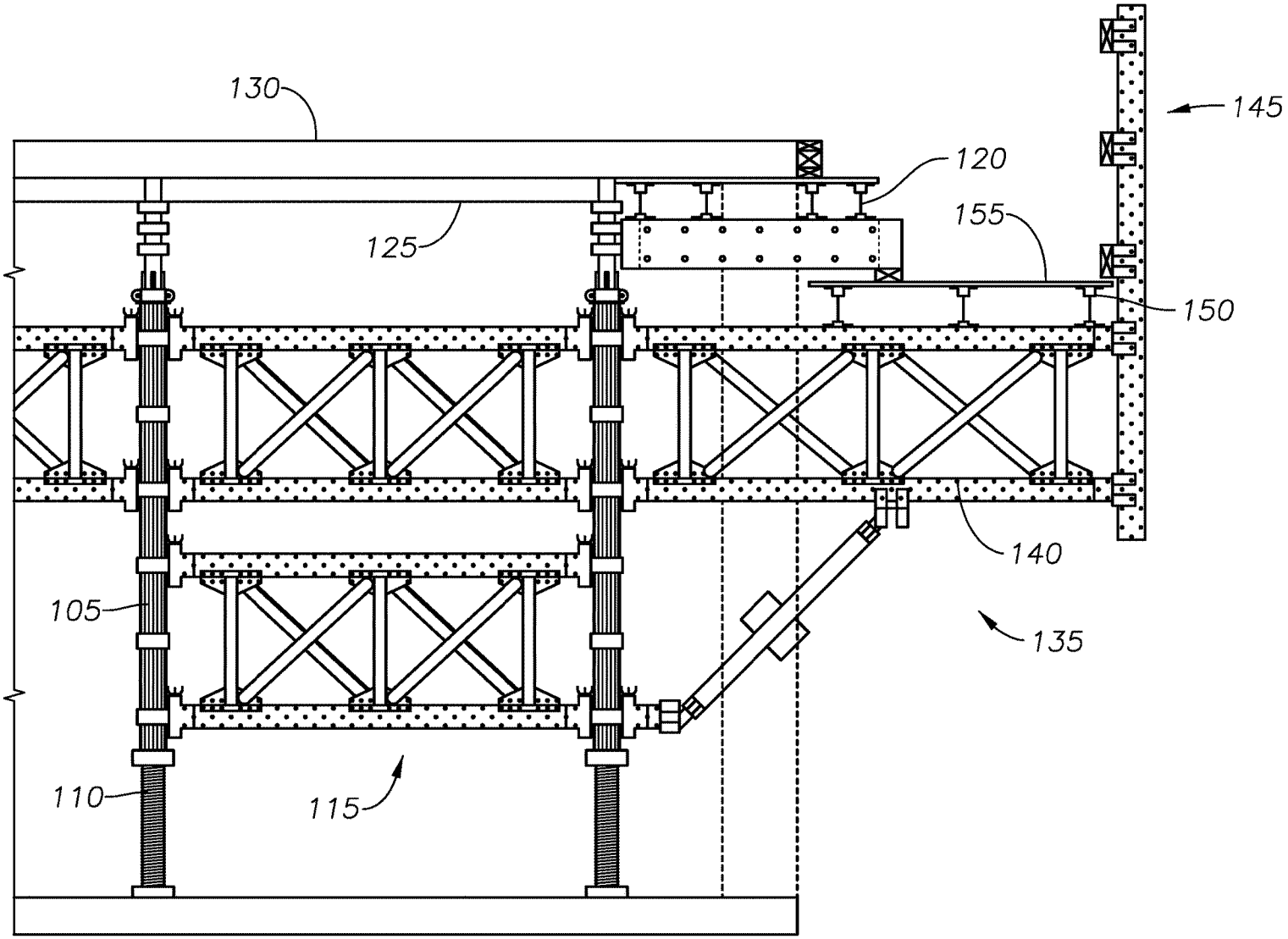
FIG. 1 illustrates a shoring system using components of an integrated construction system in accordance with implementations of various techniques described herein.

The integrated construction system of the present disclosure was designed to rectify many of the shortcomings conventional systems, including to further reduce the amount of components needed and maintain a high degree of versatility. In addition, the present integrated construction system is primarily built from non-welded lightweight aluminum components, with minimal steel items used for various fittings and connectors.

As stated above, prior art forming and shoring systems were designed to be independent. Besides the integrated construction system described in the present disclosure and the system disclosed in Applicant's related co-pending U.S. patent application Ser. No. 15/630,923, which is herein incorporated by reference, there is no integrated system disclosed in the prior art where standard elements of the integrated system can be used in both a formwork system configuration and a shoring system configuration. The present integrated construction system functions as one complete system for both vertical and horizontal aspects of concrete construction. The present integrated construction system can also be configured to provide a heavy-duty access or scaffolding system.

The present disclosure provides a shoring system that is part of a larger integrated construction system. This shoring system includes several key unique features that are not found in similar systems currently available in the market. These unique features are outlined below.

None of the prior art individual construction systems provides a system that provides the aspects of formwork, shoring and provision of safe worker access during construction. The present integrated construction system forms part of a complete "construction system" offering that satisfies all three of the aforementioned aspects of construction.

In one implementation, the present integrated construction system provides aluminum extruded posts with mechanically fastened cast fittings. Prior art modular aluminum shoring systems have bracing ledger and base attachment aluminum welded fittings. However, many of the prior art shoring systems do not have ledger fittings and, therefore, do not provide any capacity for the ledgers to carry any appreciable load. The present shoring systems provide post fittings attached with mechanical fasteners that are designed to carry loads for multiple situations.

In one implementation, the present integrated construction system provides a multipurpose aluminum and steel modular ledger. The ledgers may be made from a hybrid of aluminum and steel components vs. welded aluminum.

The ledgers can be configured into a variety of assemblies for a multitude of applications vs. static sized bracing panels. The ledgers are designed to act as a truss or load bearing member (e.g., vertical or other types of loads) vs. being used solely as a bracing and spacing member.

The ledger post connections have a removable series of end connections for various uses. The ledger post connections are not permanently mounted and are designed for multiple purposes as opposed to being designed for a single purpose.

The modular ledger is designed to be useable as: a bracing/spacing panel between vertical posts; a headload or truss shoring member that can hold up shoring loads in a variety of situations; an access platform for vertical shear-wall construction; a roof truss system for large enclosures; and a perimeter safety deck system for construction worker access.

In one implementation, the present integrated construction system provides safety deck solutions for worker access. Safe construction worker access is an important aspect of all high-rise concrete construction projects. The present integrated construction system provides safe worker access to the outer perimeter of floor slab construction during all phases of: a floor pour, shoring setup, slab pour, post-tensioning slab cables, and continuous setup of the next level of shoring. Prior art systems use the actual slab shoring structure to give workers access to the perimeter of the top floor under construction. The problem with the prior art is that once the shoring is stripped, there is no effective means of access to the outer perimeter of a previously constructed floor slab. The issues present in prior art worker access slow down the construction cycle. The present integrated construction system provides perimeter deck access that is provided using components of the integrated construction system but independent of the shoring deck itself, to give worker access to the outer perimeter of the work. This allows the lower level access to remain in place to allow workers continued perimeter access to lower levels, while the upper level construction continues.

In one implementation, the present integrated construction system provides applications for heavy duty access. Conventional scaffolding systems are generally used to give workers access to general construction tasks. However, when the applications become extremely high or when the system incurs higher than normal loading conditions, other means of worker access are generally required. The present integrated construction system is able to provide worker access in higher than normal loading situations, while still meeting all OSHA access regulations.

In one implementation, the present integrated construction system provides heavy duty enclosures. Enclosures or containment structures are a common form of providing environmentally controlled spaces when critical construction processes require weather or other forms of climate protection. When these enclosure structures become large or subjected to high external forces, such as wind, most conventional scaffolding systems do not have the ability to perform in these high external force conditions. The present integrated construction system is able to sustain higher than normal loads and can be configured to provide larger than normal containment structures.

In one implementation, a mega-shore application is provided. Most prior art shoring systems have either a light or medium duty rating. Other prior art shoring systems may have heavy or very heavy-duty ratings. No prior art system can function across all rating ranges. Posts coupled to a mega-shore bearing plate can be configured in a variety of ways to achieve each level of duty rating. This includes the ability to cluster posts in groups to achieve very high loads in excess of 100,000 lbs. per shore location.

FIG. 1 shows a configuration providing a shoring application using components of an integrated construction system. FIG. 1 shows primary shoring components: aluminum posts 105, aluminum adjustable screw legs 110, aluminum and/or steel ledger assemblies 115, aluminum header beams (not shown), and aluminum joists 120. The primary components are constructed and assembled together without using any aluminum welding. The primary components of the shoring configuration are designed for multiple uses and are also designed for integration with formwork components of the integrated construction system. For example, the 6 foot panels 125 used to form slab 130 are configured for use in both formwork and shoring applications. As detailed further below, other components in addition to the primary components are included to provide additional applications for roll-back formwork, mega-shoring, perimeter safety deck systems, and heavy duty access systems.

An example of a perimeter safety deck system 135 is also shown in FIG. 1. This example perimeter safety deck for worker access includes a ledger assembly 140, a plurality of ledger rails coupled together to form an outer wall 145 (although multiple ledger rails are shown in this example, a single ledger rail may also be used to form the outer wall). In the example shown in FIG. 1, joists 150 are coupled to the bracing assembly and are used to support a platform 155, e.g., a wood platform.

Figure 2:
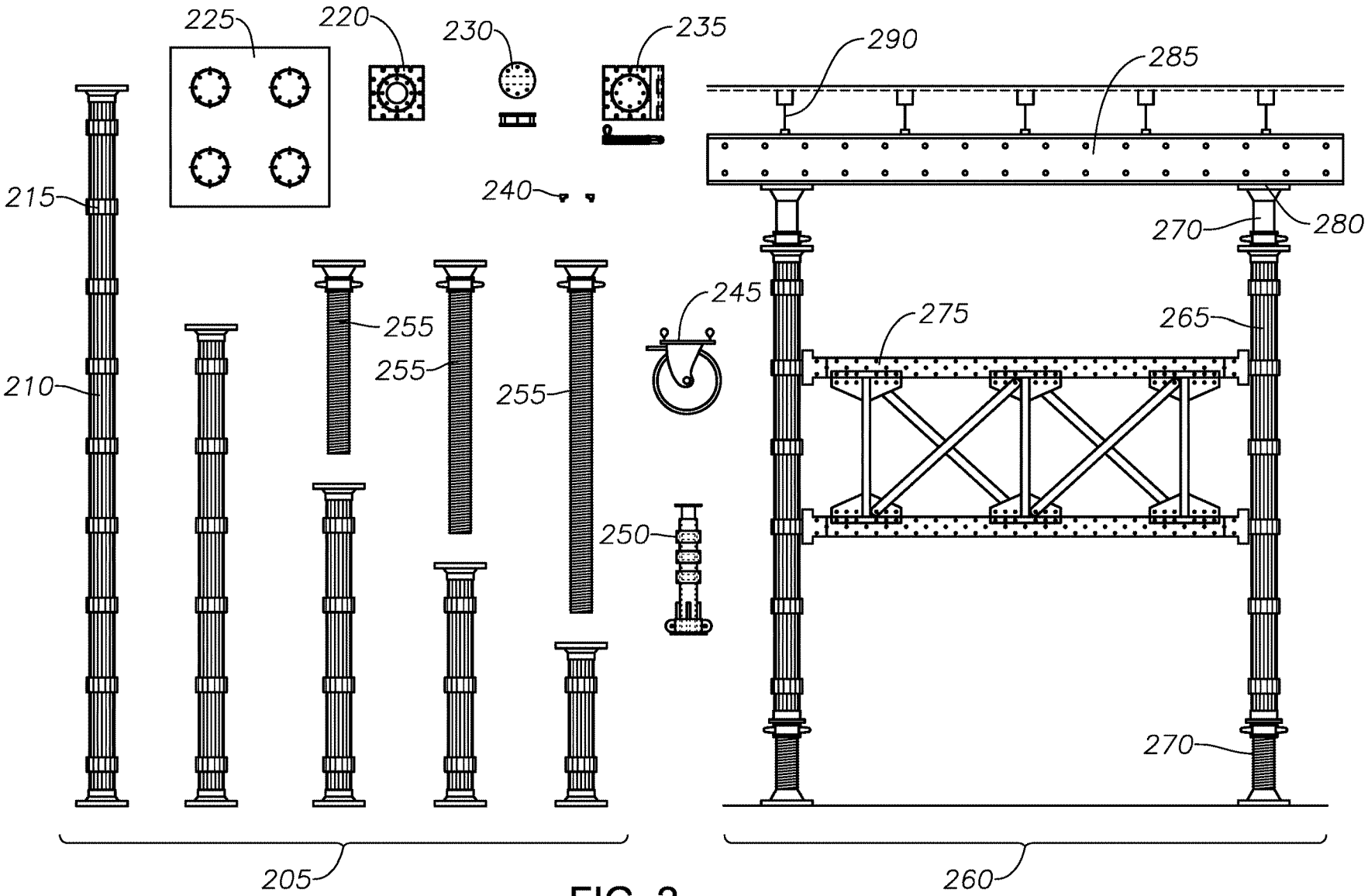
FIG. 2 illustrates various system component drawings for modular vertical posts and post components in accordance with implementations of various techniques described herein.

FIG. 2 includes various system component drawings for modular vertical posts 205 that include post components 210, 215 of the shoring system. The modular vertical posts 205 may be provided in various lengths. In one implementation, the modular vertical posts 205 have lengths of 2 feet, 3 feet, 4 feet, 6 feet and 9 feet. Each of the posts 205 is made up of a longitudinal extruded post 210 and independent fittings, e.g., ledger fitting 215, that are fastened to the post. The independent fittings are not welded to the post. The independent fittings are, instead, mechanically fastened. The fittings are coupled to the post by sliding the fitting down the post, twisting the fitting into place and mechanically fastening the fitting to the post. The fitting is twisted into place using a groove lathed into the ribs of the post 205. The groove is obscured by the fitting 215. Fittings are placed onto the post at predetermined intervals. In one implementation, fittings fastened to the post are placed 12 inches apart.

Screw legs 255 are provided in various lengths and are used to adjust a height of the vertical post. The height of the post may be adjusted by using the screw legs on one or both ends of the vertical post. The bearing plate 220, mega-shore bearing plate 225, slope bracket 230, post hinge 235, screw leg connector clips 240, swivel caster shoe 245, and deck drophead 250 are used with the vertical posts to provide various shoring application configurations. FIG. 2 further includes a side view of one configuration of a shoring assembly 260 using vertical posts 265, screw legs 270, the ledger panel assembly 275, bearing plates 280, a header beam 285, and joists 290.

Figure 3:
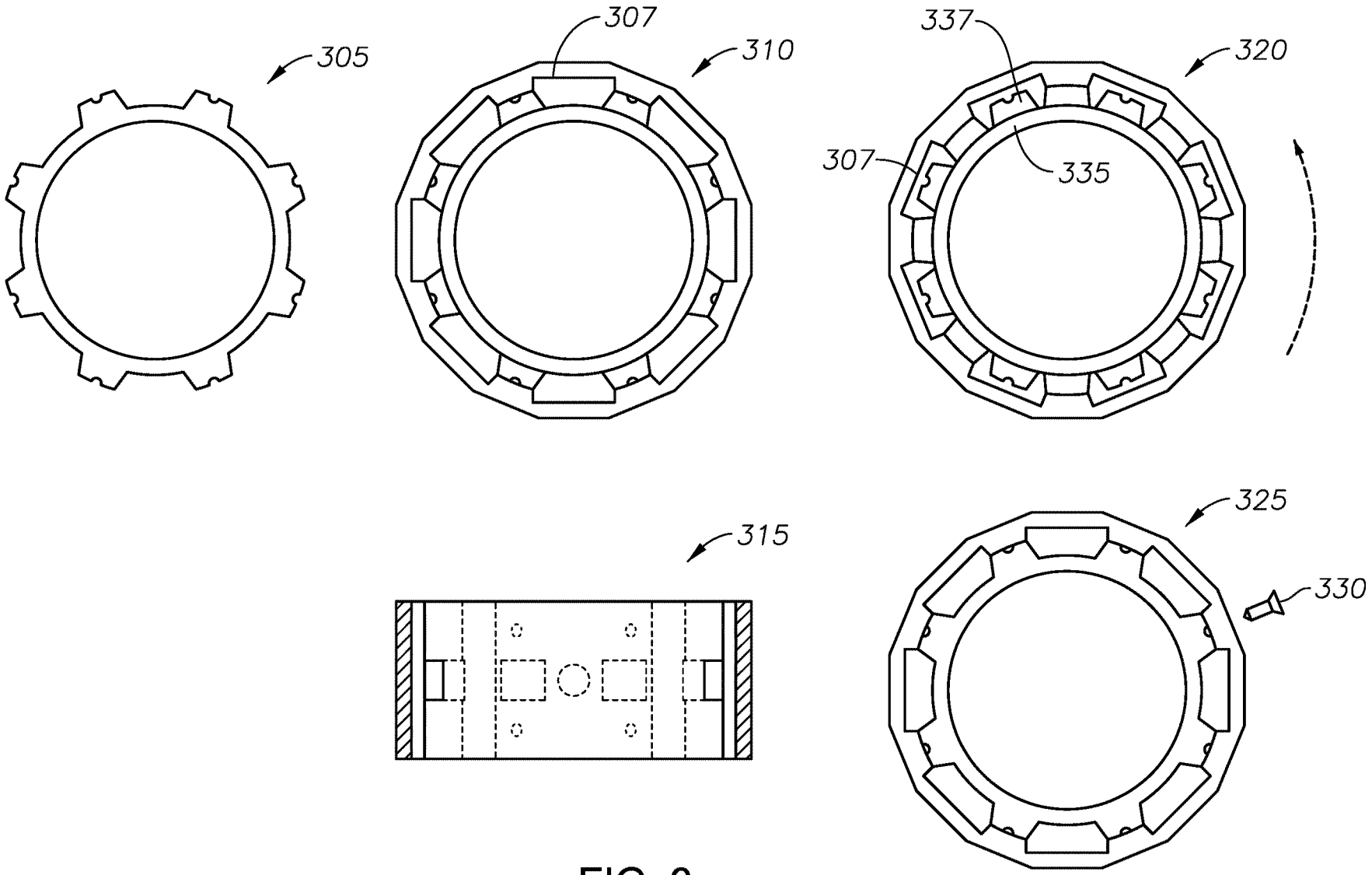
FIG. 3 illustrates details of a post extrusion and a ledger fitting in accordance with implementations of various techniques described herein.

FIG. 3 shows details of a post extrusion and a ledger fitting. FIG. 3 shows a cross-sectional view of post 305. Post 305 is an extruded aluminum post. Also shown is a fitting, e.g., fitting ring 307. Fitting ring 307 is used to attach a ledger or ledger assembly to post 305. Ledgers and ledger assemblies are described in more detail below in FIGS. 13-17. In one implementation, the fitting ring 310 is spaced every 12 inches along the post 305.

As also described above in FIG. 2, the fitting ring 307 is slid down the post 305 and then twisted into place on the post 305. After twisting the fitting ring 307 into place on the post 305, the fitting ring 307 is mechanically fastened to the post, e.g., with a screw. The feature is unique to this system, as all others weld connection fittings to the posts The post 305 is configured to be a complete extruded piece, e.g., constructed of aluminum. The post 305 is cut to a specific length. A groove is lathed into the circumference of the post 305 at predetermined locations along the post. In one implementation, the groove is lathed into the post every 12 inches. In one implementation, the groove is a ½ inch cut groove. The fitting ring 307 slides down the post and twists into place at each groove. View 320 shows the fitting ring 307 being twisted into the groove (not shown). View 320 shows a circular shaft portion 335 of the post 305. View 320 also shows an outer rib portion 337 of the post 305 that remains below the groove. The groove is cut on the vertical ribs of the extrusion, not on the circular shaft. In one implementation, screws may fasten the fittings into place to prevent them from moving.

View 310 and 315 are top and side views of the fitting ring 307, respectively. As previously described, the rings are twisted into place as shown in view 320 and mechanically fastened as shown in view 325, e.g., using screw 330.

Configuring posts in the manner described above allows for the installation of posts and ledgers without welding. In addition, configuring posts in this manner further allows posts to take a load. Prior art systems don't allow a ledger to put a load from a ledger onto a post.

Figure 4:
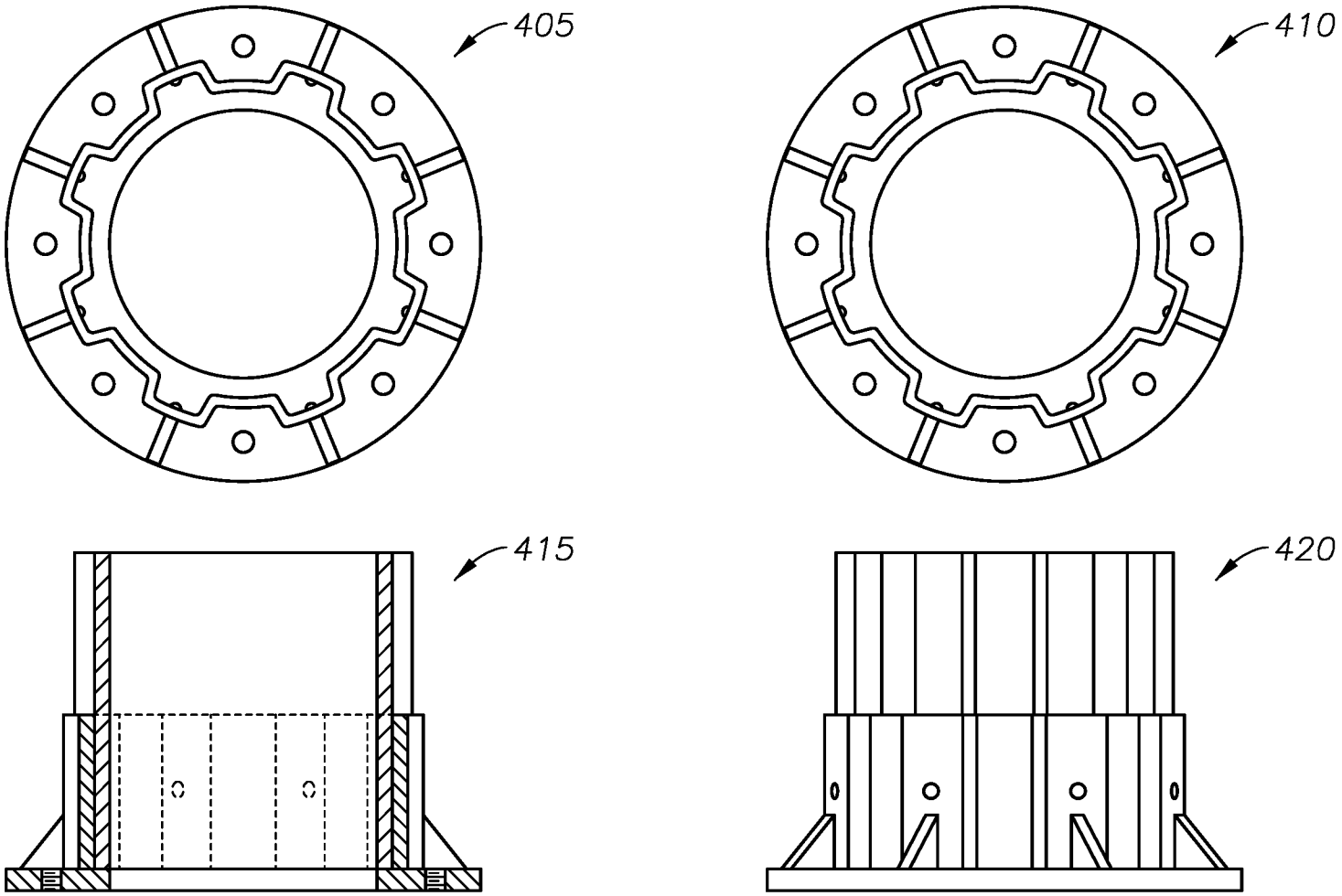
FIG. 4 illustrates various views of a post end fitting in accordance with implementations of various techniques described herein.

FIG. 4 shows various views 405, 410, 415, 420 of a post end fitting. View 405 is a top cross-sectional view of a post end fitting. Views 410, 415, 420 are top cross-sectional, side cross-sectional, and side view respectively, of a post end fitting coupled to a post. The post end fitting can be used on a top portion and a bottom portion of each post. In one implementation, the post end fitting is configured to be a permanent fitting.

Figure 5:
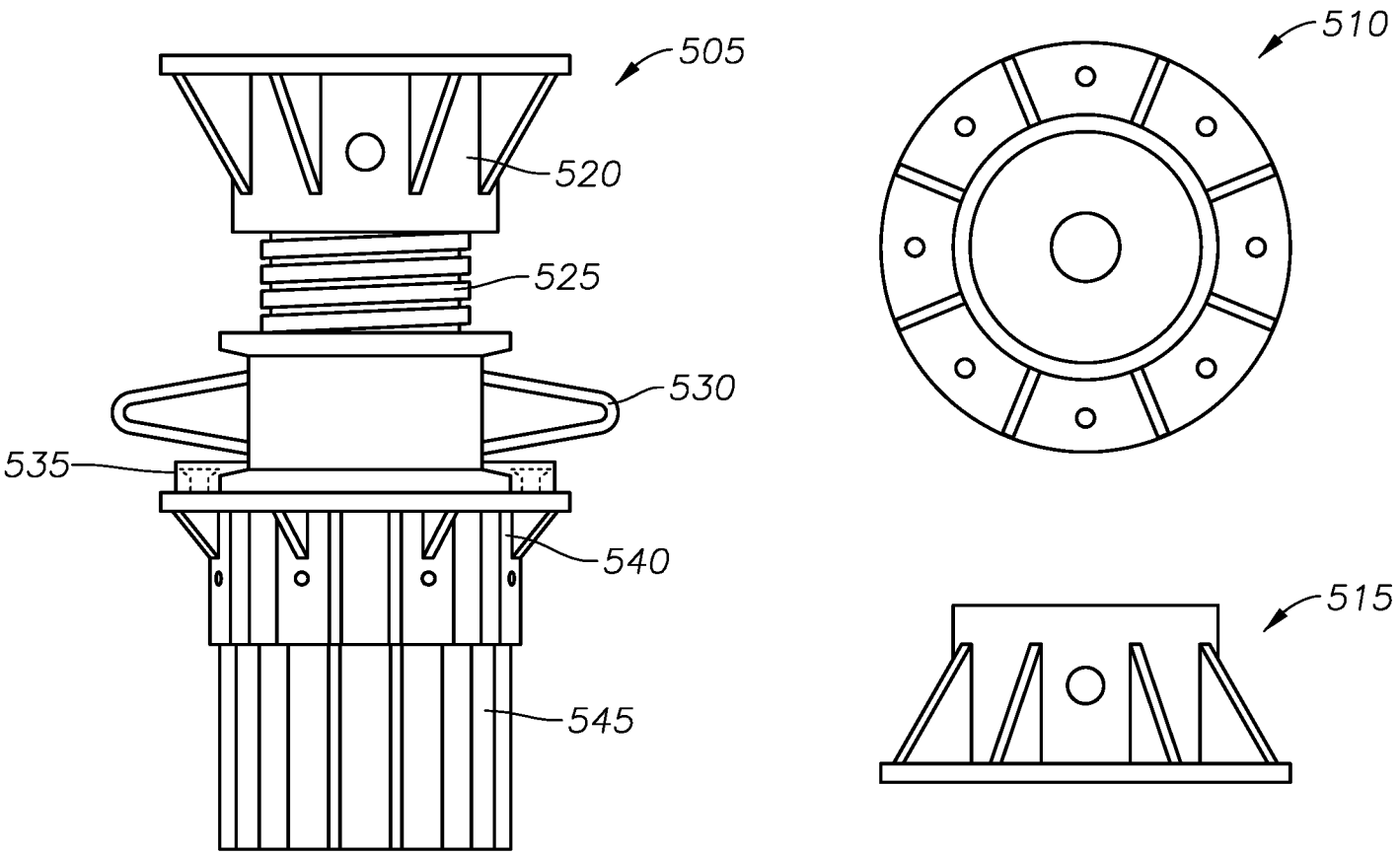
FIG. 5 illustrates various views of screw leg components in accordance with implementations of various techniques described herein.

FIG. 5 shows various views 505, 510, 515 of screw leg components. One portion of FIG. 5 shows aside view 505 of a post and screw leg assembly. This view shows a screw leg end fitting 520, a screw leg thread 525, a screw leg adjusting nut 530, screw leg connector clips 535, a post end fitting 540, and an aluminum post 545. The screw leg connector clips 535 allow the screw leg 520, 525, 530 to attach to the post end fitting 540 and fly with the post after a pour.

Shoring is generally used repetitively from one concrete pour to the next. In typical prior art shoring systems, the shoring system is completely disassembled and then re-assembled on the next position. The present integrated construction system provides the ability to keep much of the setup intact and fly the assembly with a crane from one setup to the next to reduce labor costs. The screw leg clips allow the screw legs to remain attached to the posts, so the screw legs will still turn for adjustment, but also provide the ability to move the post and screw leg as a unit from one pour to the next without being disassembled.

Another portion of FIG. 5 shows a top view 510 of a screw leg end fitting. Another portion of FIG. 5 shows a side view 515 of the screw leg end fitting. The screw leg assembly 520, 525, 530 is used to vary the height of the shoring assembly, e.g., shoring assembly 260. A portion of the screw leg assembly 520, 525, 530 fits inside of the post 545. Adjustable legs, e.g., screw legs, are used to provide a height needed for a particular application, e.g., within an adjustment range. The screw leg thread 525 is used with a screw leg end fitting 520 and a screw leg adjusting nut 530. In one implementation, the screw leg adjusting nut 530 can be a twisted wing nut. The configuration shown in FIG. 5 allows for an adjustable post having non-welded components.

Figure 6:
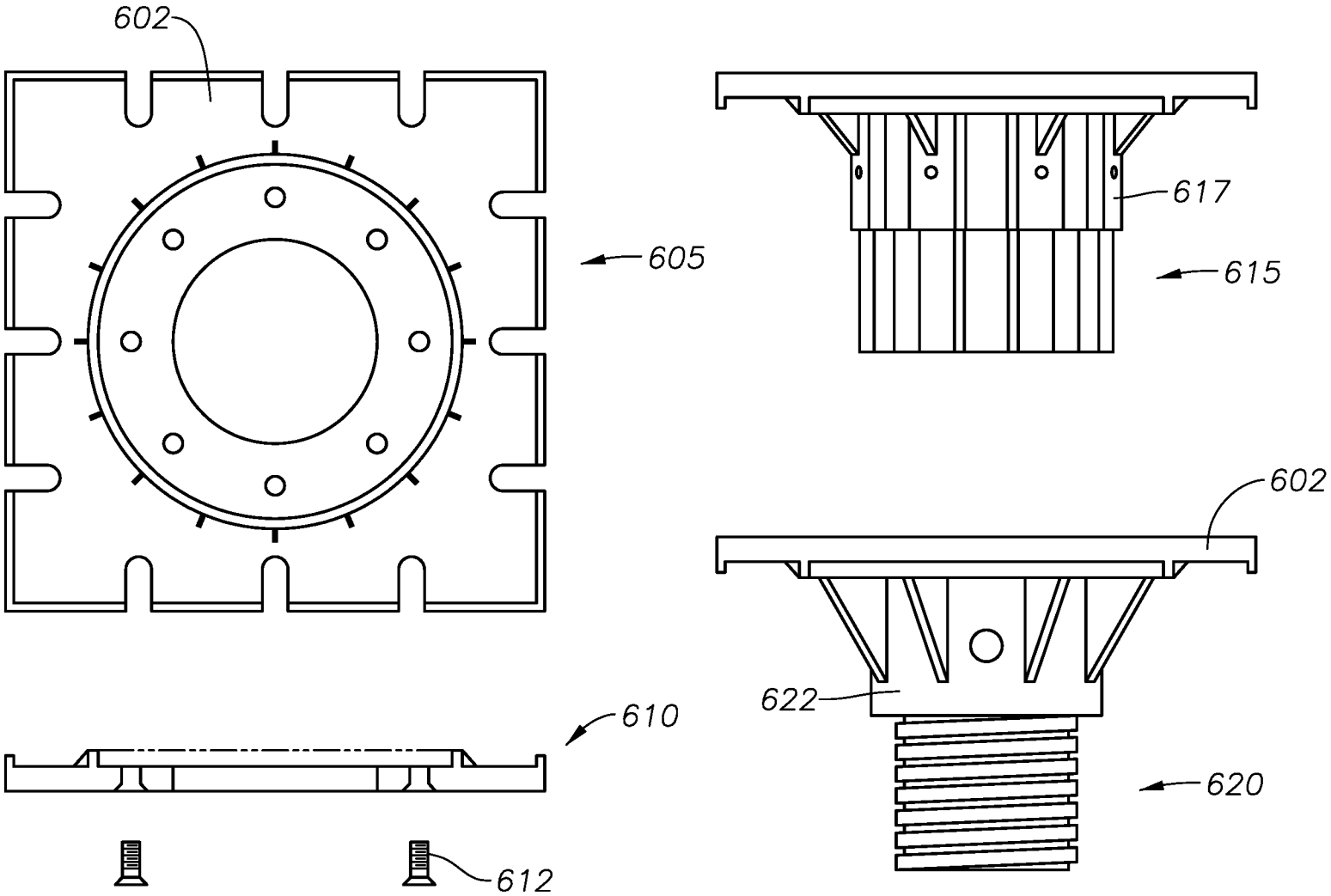
FIG. 6 illustrates various views of a multi-purpose bearing plate in accordance with implementations of various techniques described herein.

FIGS. 6-10 show a multi-purpose bearing plate in various configurations. FIG. 6 shows various views 605, 610, 615, 620. View 605 is a top view of the multi-purpose bearing plate 602. View 610 is a side view of the multi-purpose bearing plate and screws 612 that are used to couple the bearing plate 602 to other components of the shoring system. View 615 is a side view of the multi-purpose bearing plate coupled to a post end fitting 617. View 620 is a side view of the multi-purpose bearing plate 602 coupled to a screw leg end fitting 622. The multi-purpose bearing plate 602 can be used on a top portion of a shoring assembly and/or a bottom portion of a shoring assembly.

Figure 7:
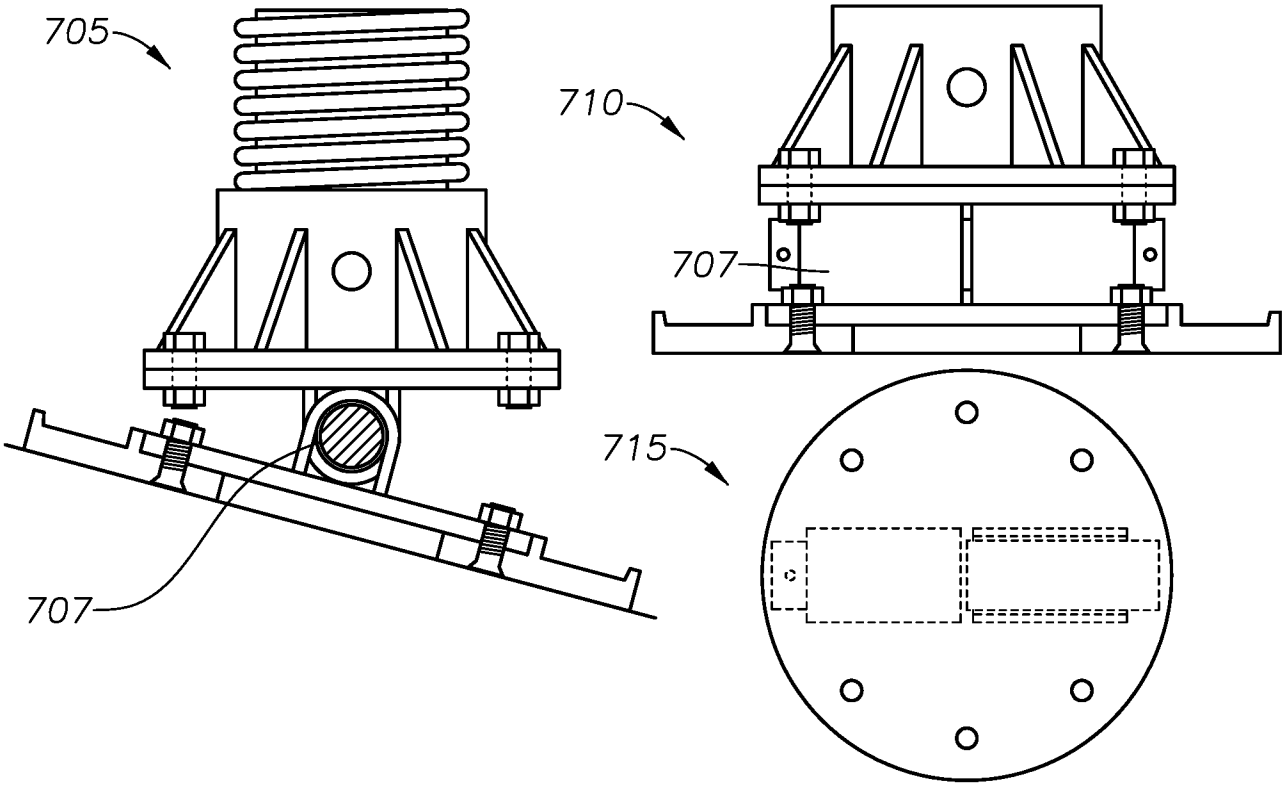
FIG. 7 illustrates various views of a multi-purpose bearing plate in a slope bracket configuration in accordance with implementations of various techniques described herein.

FIG. 7 shows various views 705, 710, 715 of a multi-purpose bearing plate in a slope bracket configuration. View 705 is a view of the slope bracket configuration showing a front/rear portion of the slope bracket 707. View 710 is a view of the slope bracket configuration showing a side view of the slope bracket 707. View 715 is a plan view of the slope bracket. The slope bracket configuration is utilized in sloped surface applications or sloped beam applications.

Figure 8:
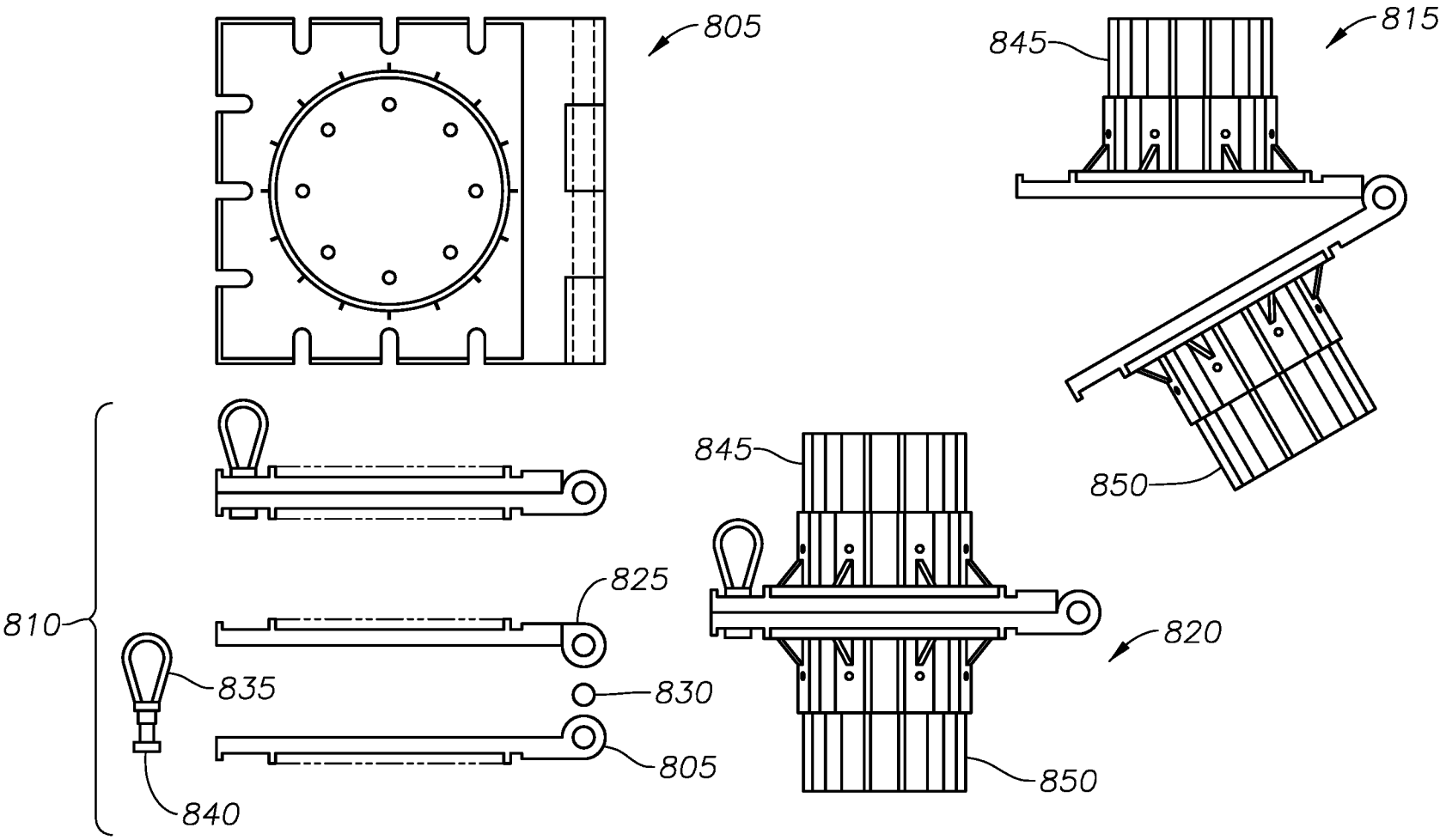
FIG. 8 illustrates various views of a post hinge attachment in accordance with implementations of various techniques described herein.

FIG. 8 shows various views of a post hinge attachment. View 805 shows a bottom plate of a post hinge assembly. View 810 shows a post hinge assembly, which includes a top plate 825, the bottom plate 805, a barrel 830, and a screw fastener 835 and screw 840. View 815 shows the post hinge assembly with posts 845, 850 in an open state. View 820 shows the post hinge assembly with posts 845, 850 in a closed state. The post hinge assembly is useful in moving shoring components.

Figure 9:
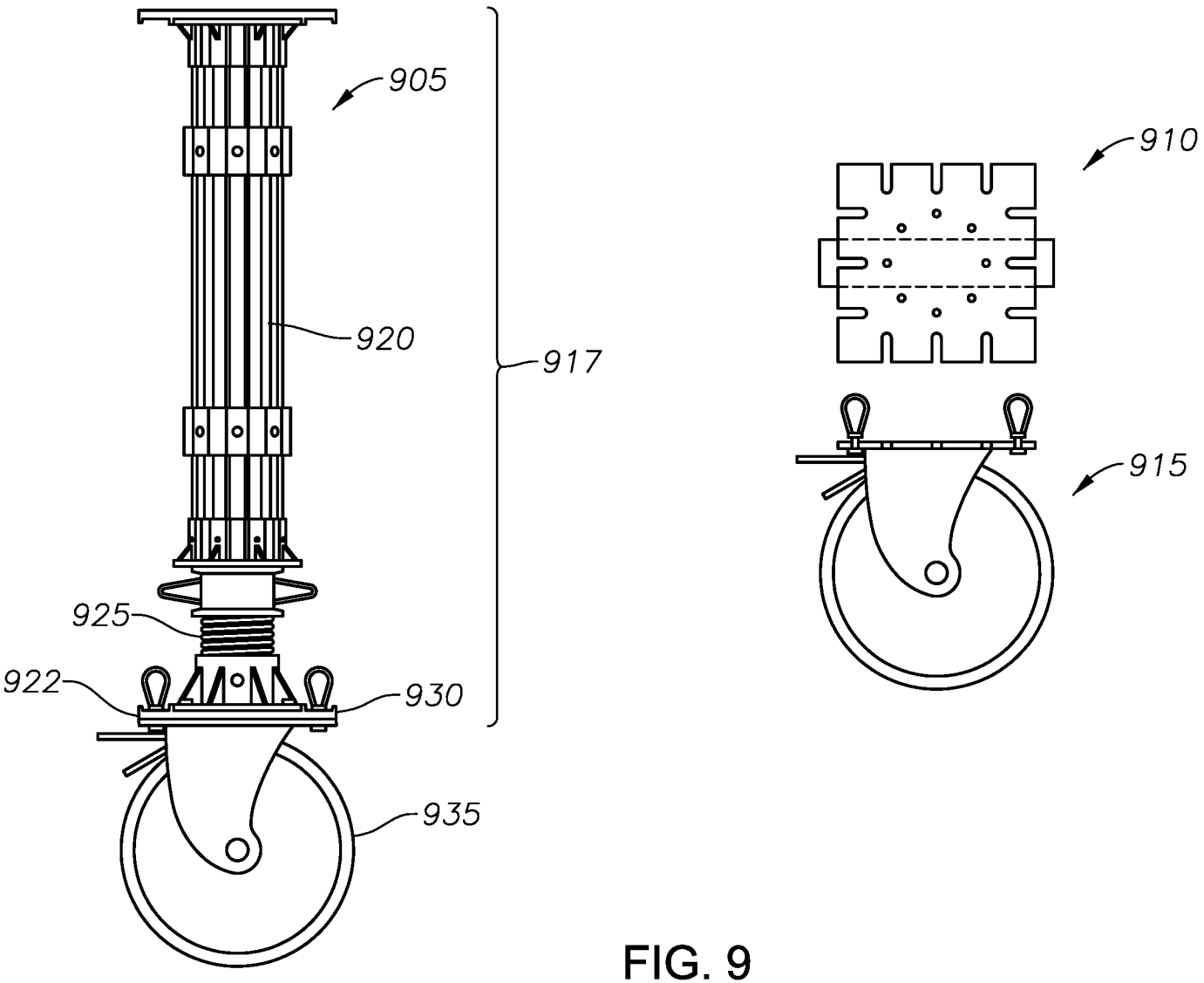
FIG. 9 illustrates various views of a swivel caster shoe in accordance with implementations of various techniques described herein.

FIG. 9 shows various views 905, 910, 915 of a swivel caster shoe. Swivel caster shoes can be mounted to a post assembly 917 using the multi-purpose bearing plate 922. View 905 shows one implementation of a swivel caster shoe 935 coupled to a post assembly 920 and a screw leg assembly 925 using a multi-purpose bearing plate 930. View 910 is a top view of the swivel caster shoe. View 915 is side view of the swivel caster shoe.

Figure 10:
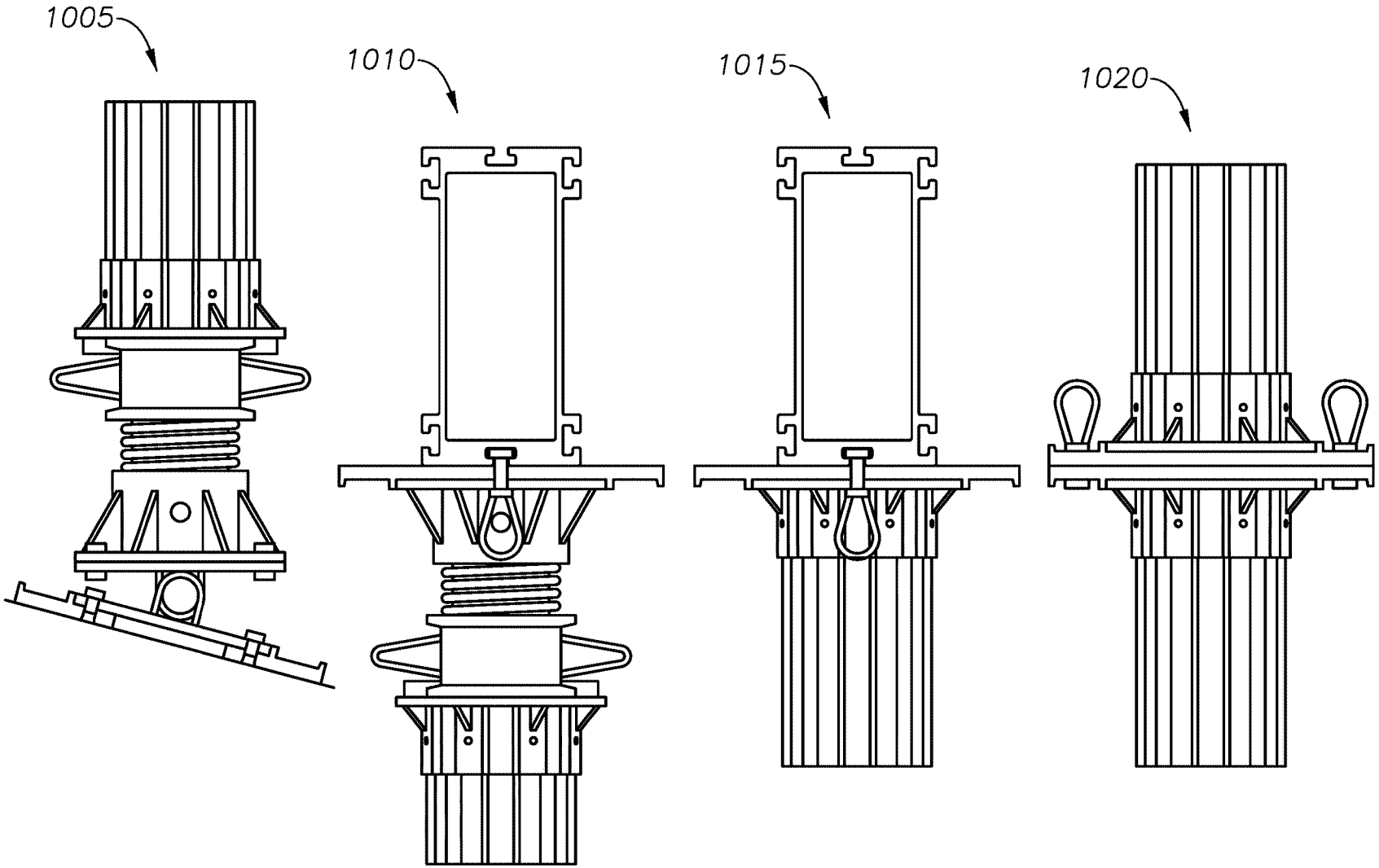
FIG. 10 illustrates different standard post assembly applications using the multi-purpose bearing plate in accordance with implementations of various techniques described herein.

FIG. 10 shows views 1005, 1010, 1015, 1020 of different standard post assembly applications using the multi-purpose bearing plate. In other words, the same multi-purpose bearing plate can be used for different applications. The prior art uses different bearing plates for different applications. View 1005 shows a sloped slab application. View 1010 shows a screw leg and header beam application. View 1015 shows an application where a header beam is directly coupled to the post. View 1020 shows an application where two posts are coupled together.

As shown in the various views, the modular posts can be used with the same multi-purpose bearing plate to provide different applications.

Figure 11:
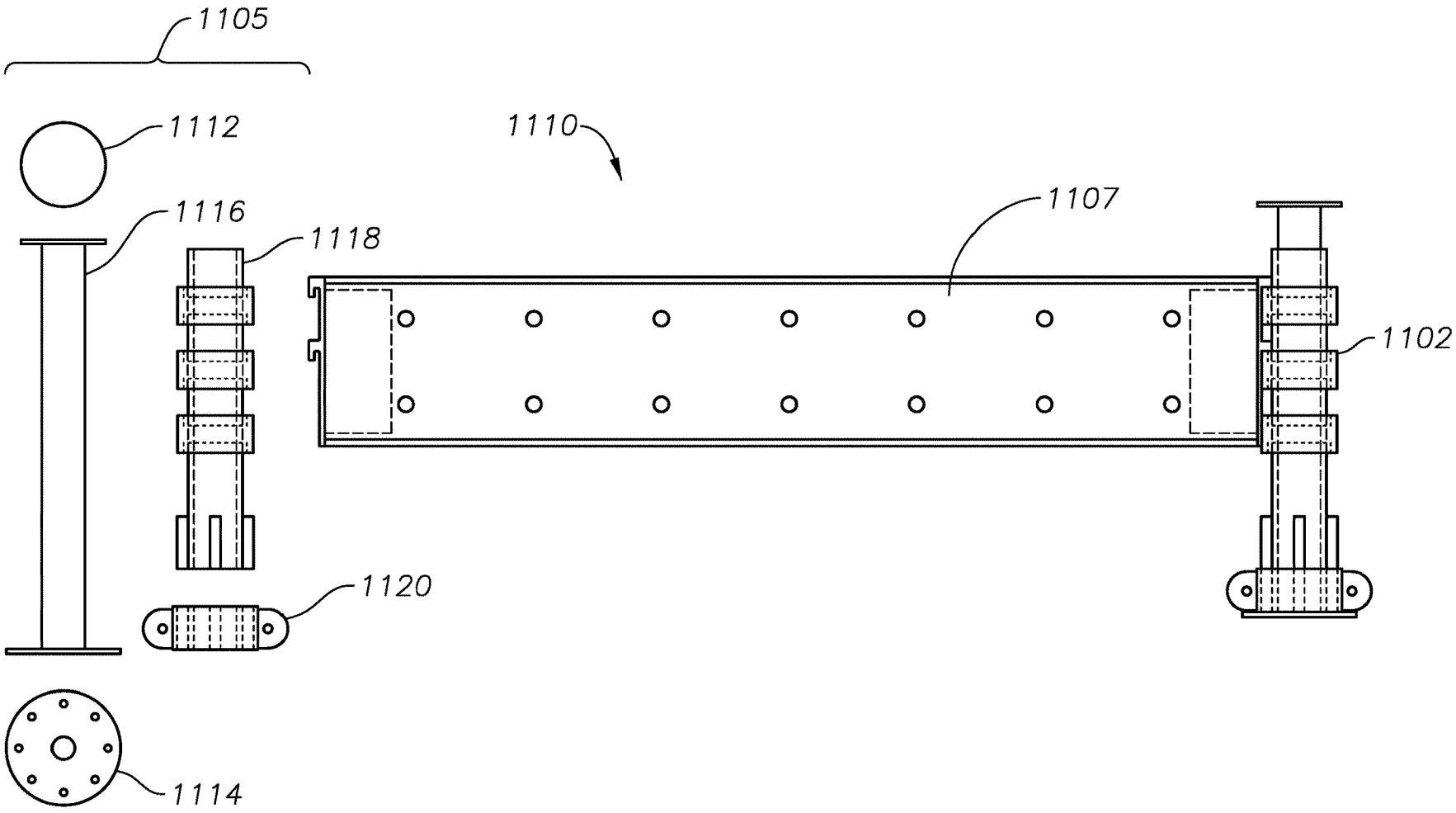
FIG. 11 illustrates drophead components and a configuration showing a drophead coupled to a modular ledger beam in accordance with implementations of various techniques described herein.

FIG. 11 shows drophead components 1105 and a configuration 1110 showing a drophead 1102 coupled to a modular ledger beam 1107. Drophead components 1105 include a drophead top plate 1112, a drophead base plate 1114, a drop head inner tube 1116, a drop head header seat 1118, and a drophead stripping nut 1120. The drophead 1102 provides the ability to drop the shoring and leave the posts in place for reshoring. The drophead components mount to the end of a post or screw leg.

Figure 12:
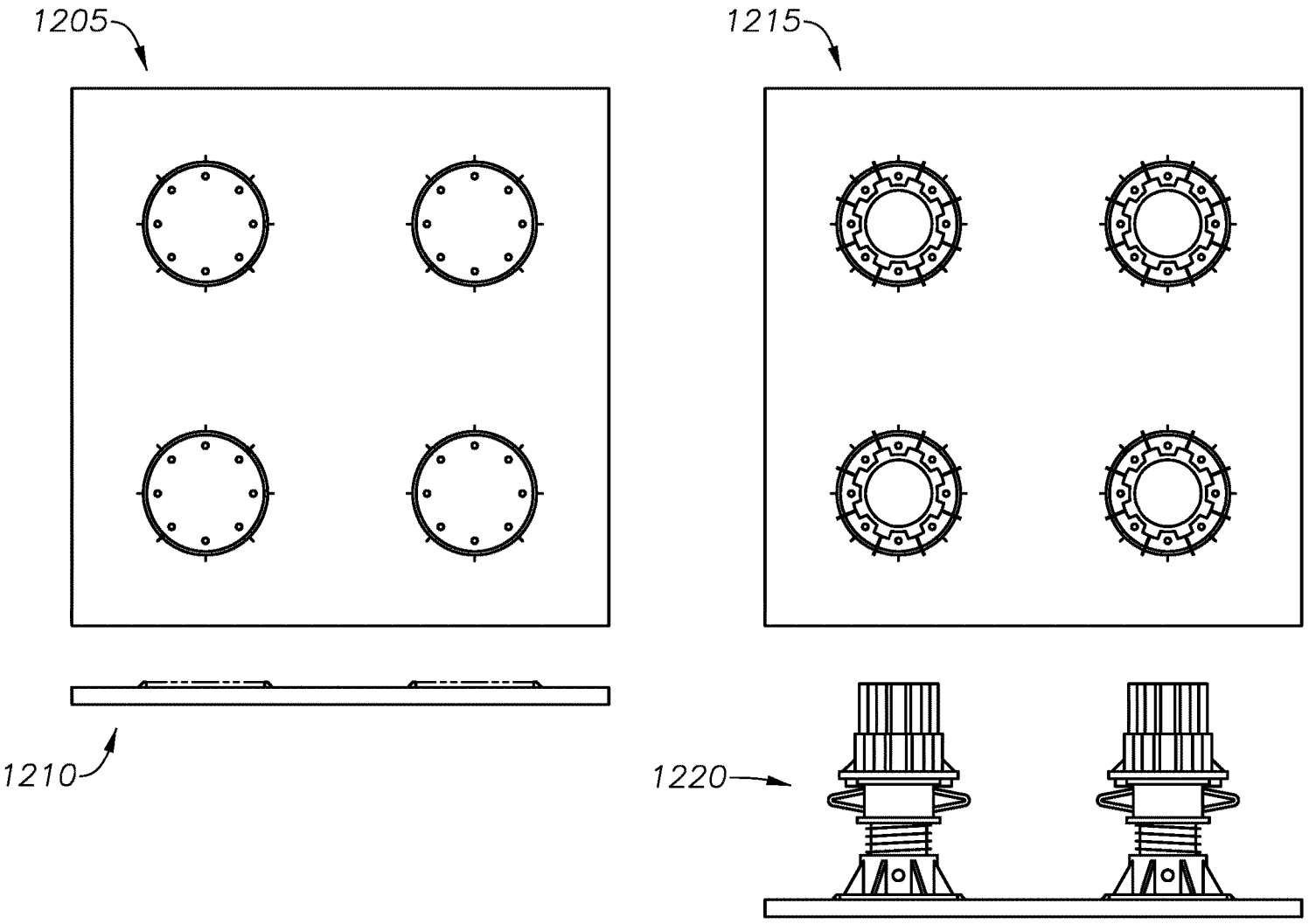
FIG. 12 illustrates various views of a heavy duty or mega-shore bearing plate in accordance with implementations of various techniques described herein.

FIG. 12 shows various views 1205, 1210, 1215, 1220 of a heavy duty or mega-shore bearing plate. View 1205 is a top view of a mega-shore bearing plate. View 1210 is a side view of the mega-shore bearing plate. View 1215 is a top view of the mega-shore bearing plate with posts installed. View 1220 is a side view of the mega-shore bearing plate with posts installed. The mega-shore or heavy duty bearing plate is used to cluster legs together to handle a very heavy duty load. The heavy duty bearing plate may also be referred to as a high capacity bearing plate. The mega-shore bearing plate accommodates more than one post. In one implementation, the mega-shore bearing plate can accommodate a cluster of four posts.

Figure 13:
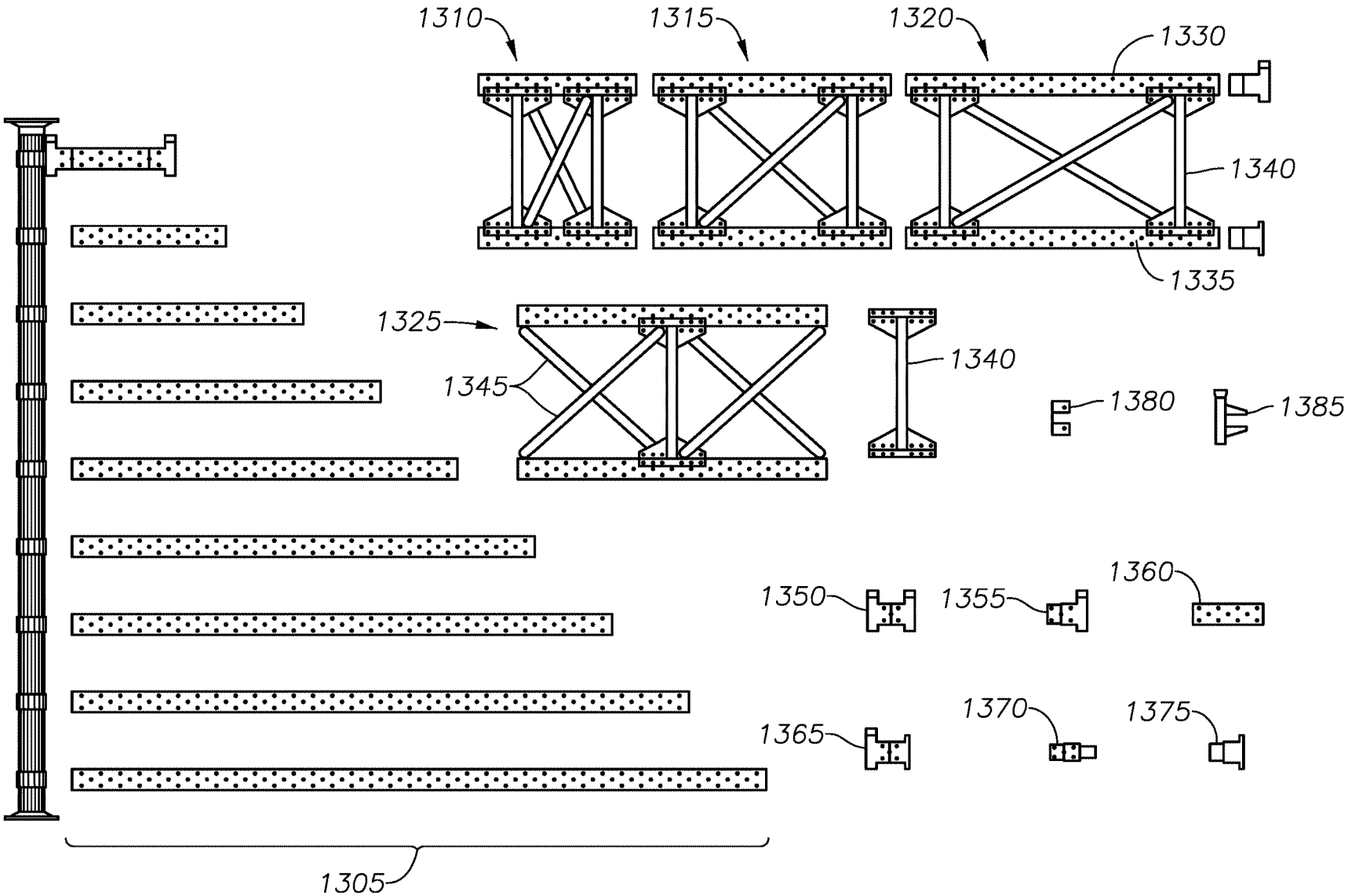
FIG. 13 illustrates various system component drawings for modular ledger panel components in accordance with implementations of various techniques described herein.

FIGS. 13-17 show various configurations for modular ledger panels. FIG. 13 includes various system component drawings for modular ledger panel components. Aluminum ledger rails 1305 of various lengths are shown. The aluminum ledger rails are hollow and can be from 1 foot to 9 feet long. Each ledger rail 1305 includes a plurality of holes placed longitudinally along each side of the rail. The plurality of holes are placed along the rail in a hole pattern. The hole pattern allows other components, e.g., bracing components, and assemblies, e.g., bracing assemblies, to be attached to each rail. Bracing components may include one or more ledger struts 1340. In some implementations, bracing components may include more than one ledger strut and at least two ledger brace members. Example bracing assemblies 1310, 1315, 1320, 1325 are also shown. The bracing assemblies include top 1330 and bottom 1335 ledger rails, ledger struts 1340 (e.g., steel ledger struts) and ledger brace members 1345. Also shown is a double ledger clamp assembly 1350 for 12 inch post spacing, a ledger clamp 1355, a ledger splice 1360, a ledger clamp/end assembly 1365, a ledger guardrail fitting 1370, and a ledger end fitting 1375. When end clamps, e.g., ledger clamps 1355, are coupled back to back and coupled to a post on each side, 12 inch spacing is provided from center to center of the posts. Coupling components, e.g., components 1355, 1360, 1370, 1375, may be used to couple the rails 1305 to other components, e.g., rails, posts, and/or assemblies of the integrated construction system. In addition, a standard accessory clip 1380 and a standard clamp 1385, both of which are disclosed in co-pending U.S. patent application Ser. No. 15/630,923, can be used with the ledger rails and bracing assemblies of the present disclosure. Ledger clamp/end assembly 1365 may be used to couple standard accessory clip 1380 or standard clamp 1385 to the end of a ledger. The ledger clamp assembly 1365 includes ledger clamp 1355 and ledger end fitting 1375 mated together. The ledger clamp assembly 1365 and standard accessory clip 1380 can be used for both formwork and shoring applications of the integrated construction system.

In one implementation, the standard accessory clip 1380 and the standard clamp 1385 can be used to connect formwork components to the ledger rail 1305. In one implementation, the standard accessory clip 1380 and the standard clamp 1385 are used for a one-sided formwork application. In one implementation, no ties are used for one-sided formwork. In this implementation, the ledger and posts become the lateral bracing for the formwork panels.

Figure 14:
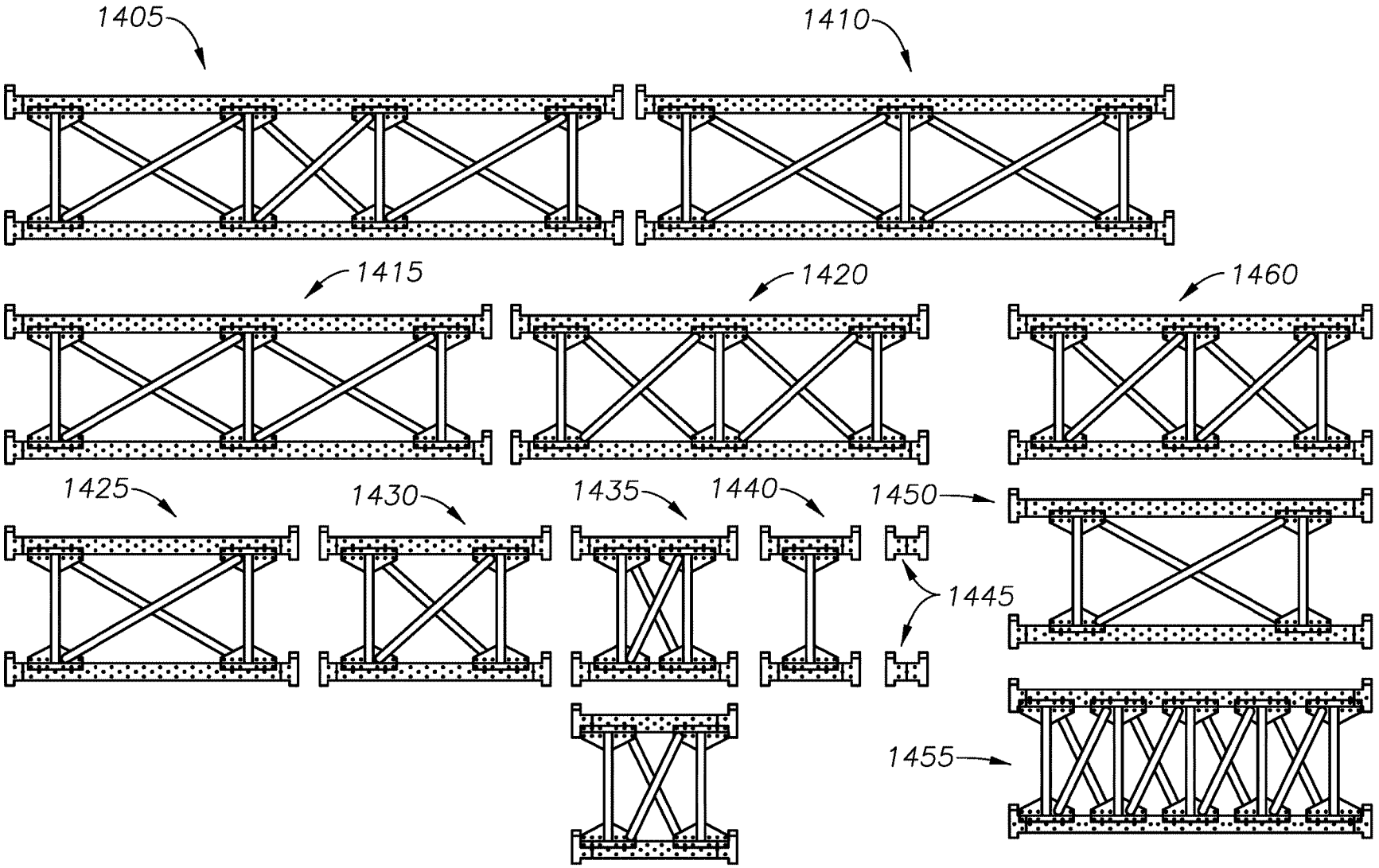
FIG. 14 illustrates various modular ledger configuration examples in accordance with implementations of various techniques described herein.

FIG. 14 shows various modular ledger configuration examples 1405, 1410, 1415, 1420, 1425, 1430, 1435, 1440, 1445, 1450, 1455, 1460. Typical bracing assemblies are shown for various lengths from 1 foot to 10 feet. The bracing assemblies may be configured to accommodate light duty (LD) and heavy duty (HD) configurations. Examples of LD, HD and standard duty configurations are shown in items 1450, 1455 and 1460, respectively. Struts can be added or removed and the cross-brace size can be changed. Load capacity can be adjusted by adding or removing bracing components.

Figure 15:
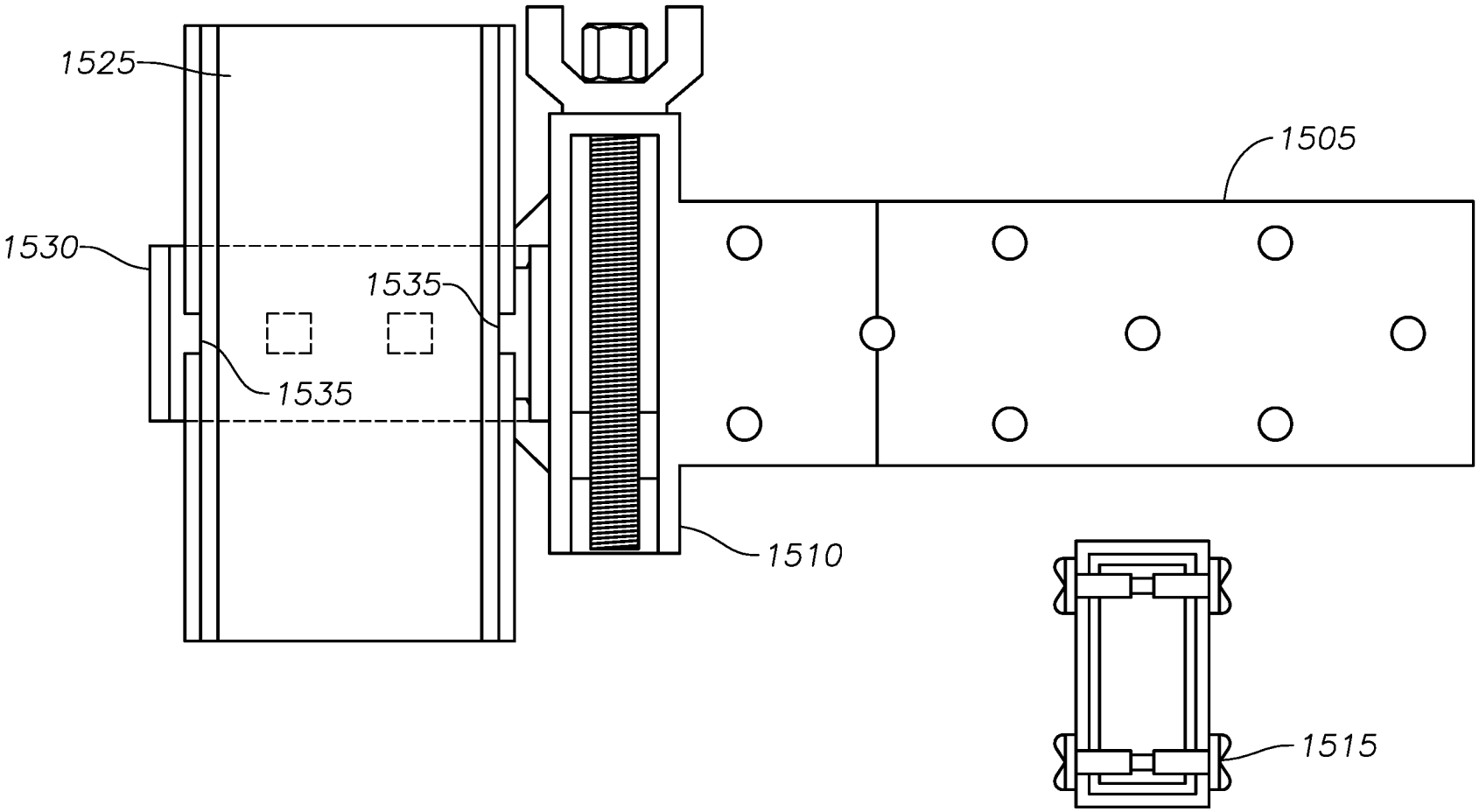
FIG. 15 illustrates a ledger clamp connection in accordance with implementations of various techniques described herein.

FIG. 15 shows a ledger clamp connection. A ledger rail 1505 is coupled to a ledger clamp 1510 using ledger connectors 1515. The ledger clamp 1510 is coupled to the post extrusion 1525 using a post ledger fitting 1530 that is attached to the post extrusion 1525 using a groove 1535.

Figure 16:
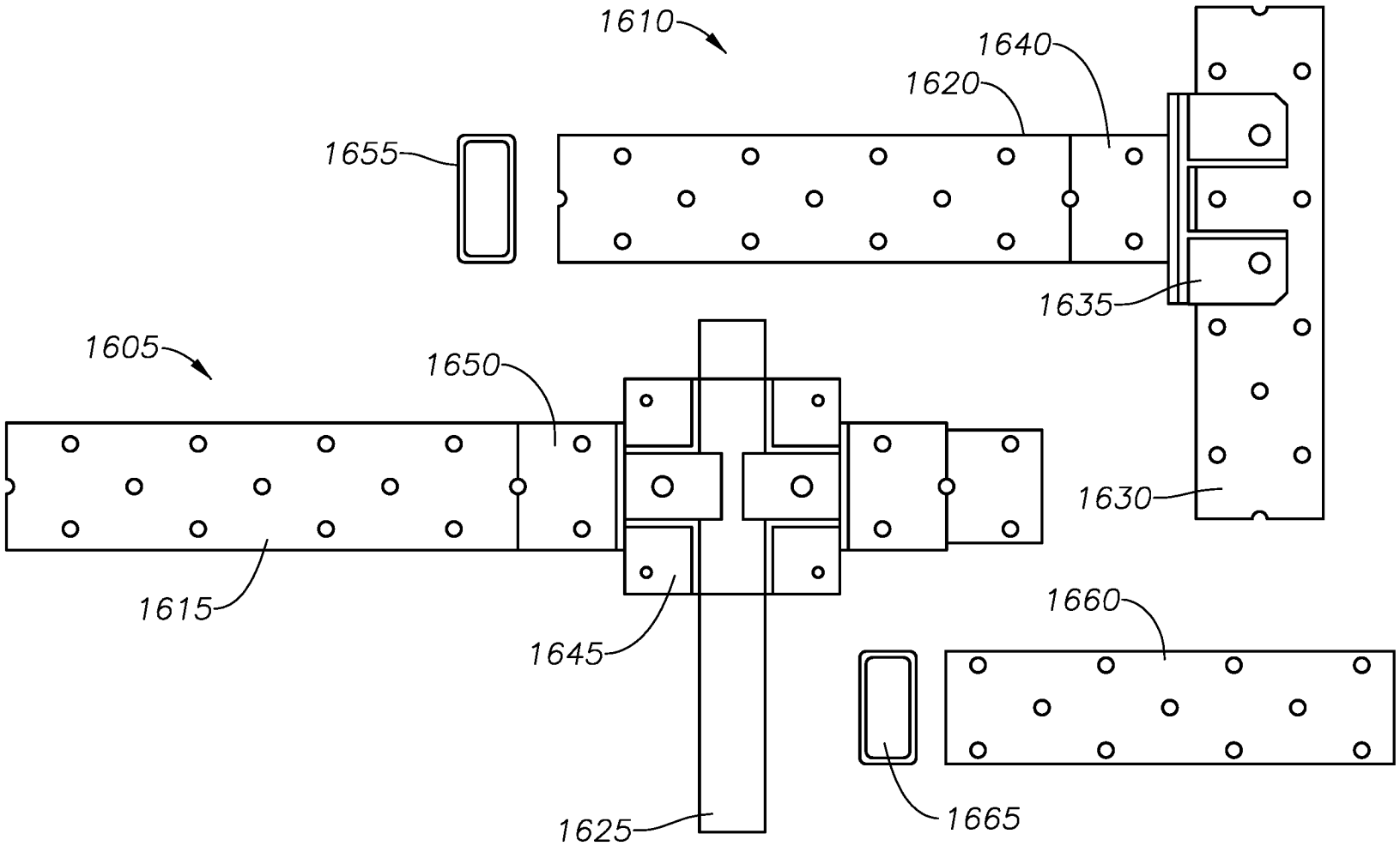
FIG. 16 illustrates ledger rail fittings in accordance with implementations of various techniques described herein.

FIG. 16 shows ledger rail fittings. Views 1605, 1610 show ledger rail fittings clamped together in configurations where a ledger in a horizontal position 1615, 1620 is clamped to a ledger in a vertical position 1625, 1630 using an accessory clip 1635 with an attached ledger end fitting 1640 (view 1605) and a double accessory clip 1645 with an attached guard rail fitting 1650 (view 1610). Also shown is a front/rear view of a ledger tube 1655, a ledger splice 1660, and a front/rear view of a ledger splice 1665.

In one implementation, ledger rail fittings provide the ability to add a vertical guardrail to the end of a cantilevered ledger. In this implementation, the cantilevered ledger is decked for worker access. The ledger rail fittings allow a guardrail to be installed on the perimeter for worker safety, e.g., to prevent falling.

Figure 17:
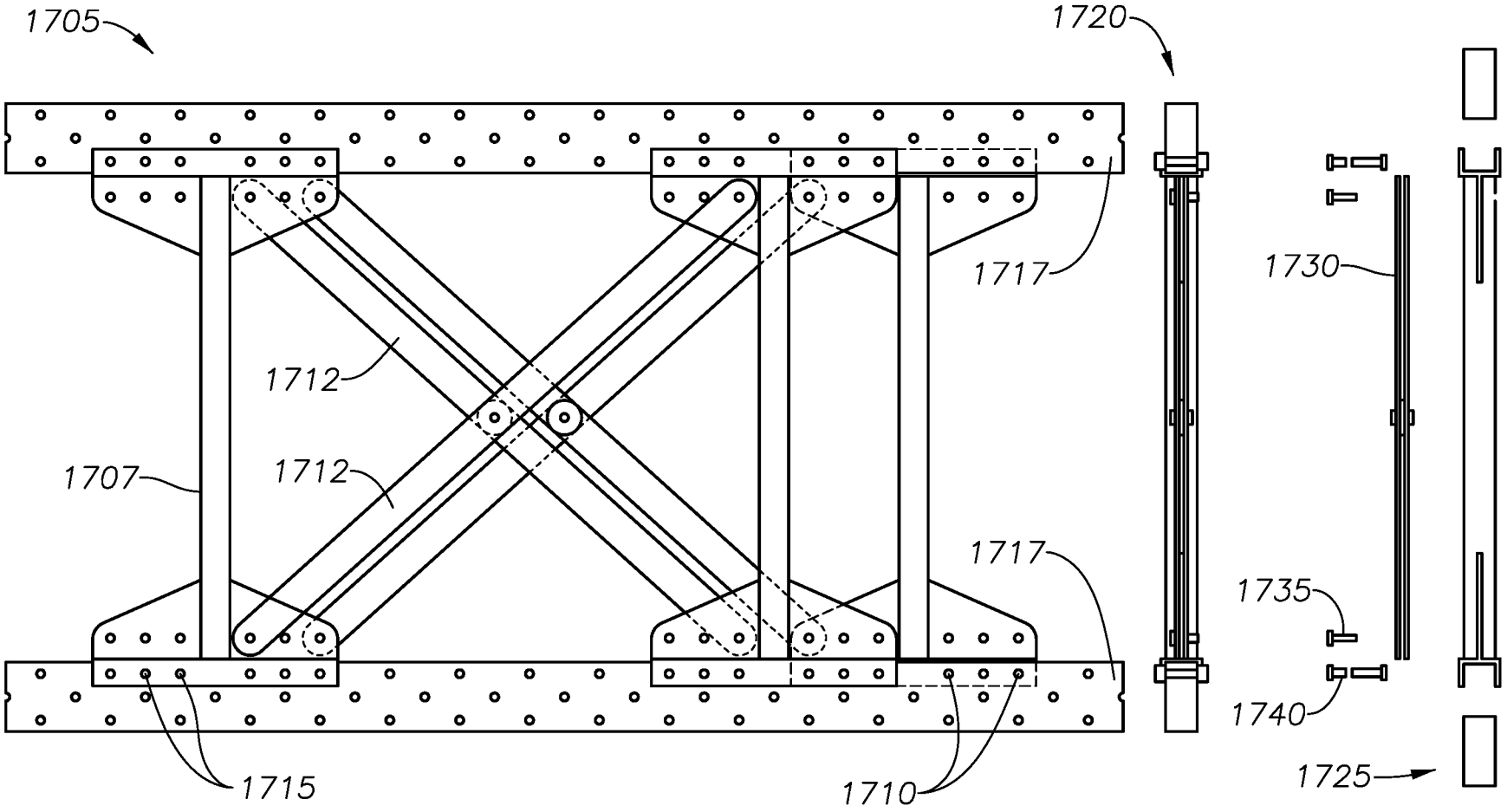
FIG. 17 illustrates a ledger strut and bracing assembly range in accordance with implementations of various techniques described herein.

FIG. 17 shows a ledger strut and bracing assembly range. The ledger strut 1707 and ledger brace members 1712 are longitudinally adjustable along a pair of ledger rails 1717 in a bracing assembly 1705. Hole patterns in the ledger struts 1715 and the ledger rails 1710 allow different spacing. In one implementation, the hole patterns are punched into the rails at the time of manufacture. The ledger struts 1707 and ledger brace members 1712 in this example configuration can be adjusted along the rails using the hole patterns 1710, 1715. In addition, spacing between the bracing can be adjusted using the hole patterns present on the ledger rails 1717 and ledger strut 1707. Also shown in FIG. 17 are a ledger end view 1720, a ledger brace 1730, an exploded ledger end view 1725, a strut connector 1740 and a brace connector 1735.

In one implementation, different spacing between the ledger rails in a bracing assembly can be achieved by using differently sized brace members 1712 with the ledger struts 1707. In one implementation, different spacing can also be achieved by adjusting lateral spacing between two ledger struts that are coupled to a brace member. In this implementation, moving ledger struts closer together or further apart and adjusting a coupling location for the brace members along the hole pattern of the ledger struts allows for different spacing to be achieved between the ledger rails.

Figure 18:
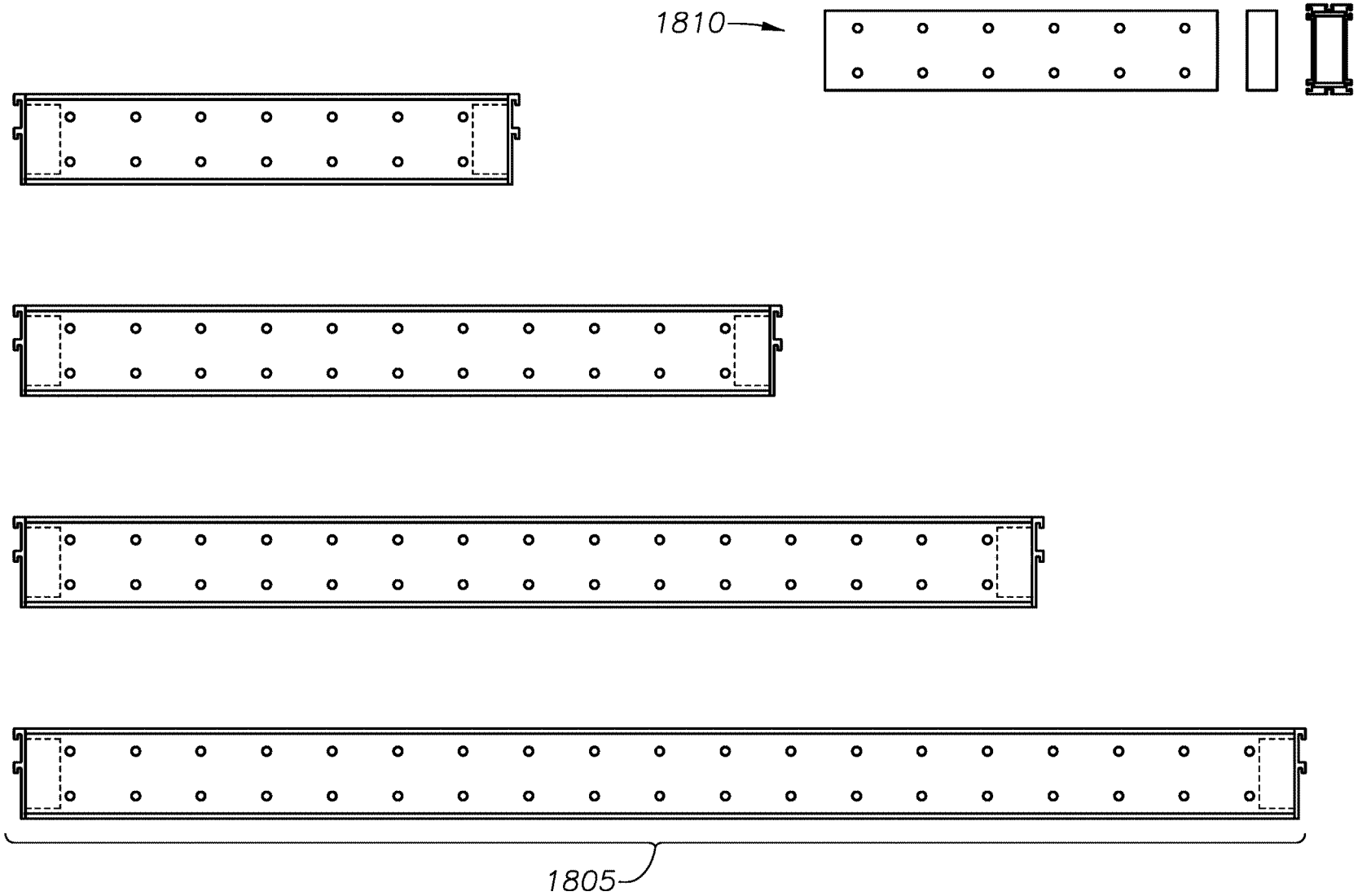
FIG. 18 illustrates examples of modular header beams in accordance with implementations of various techniques described herein.

FIG. 18 shows examples of modular header beams. Header beams 1805 may have lengths of 4 feet, 6 feet, 8 feet, and 10 feet are shown. In addition, a 3 foot header splice 1810 is shown. The modular header beams, which can be used for a drop deck shoring application are extruded out of aluminum and use modular fittings to attach to the drop deck panels. In addition, the modular header beams can be used without the fittings as open beams. When used as an open beam, e.g., a header beam, capacity can be increased and provides the ability to accept a higher load.

In one implementation, standard aluminum form panels used in a drop deck shoring application can be easily stripped from the finished concrete pour while leaving the shoring posts in place as re-shoring for the next elevated pour. Re-shoring is used to support fresh concrete floor slabs from underneath while shoring is placed on top for the next elevated floor slab pour.

Figure 19:
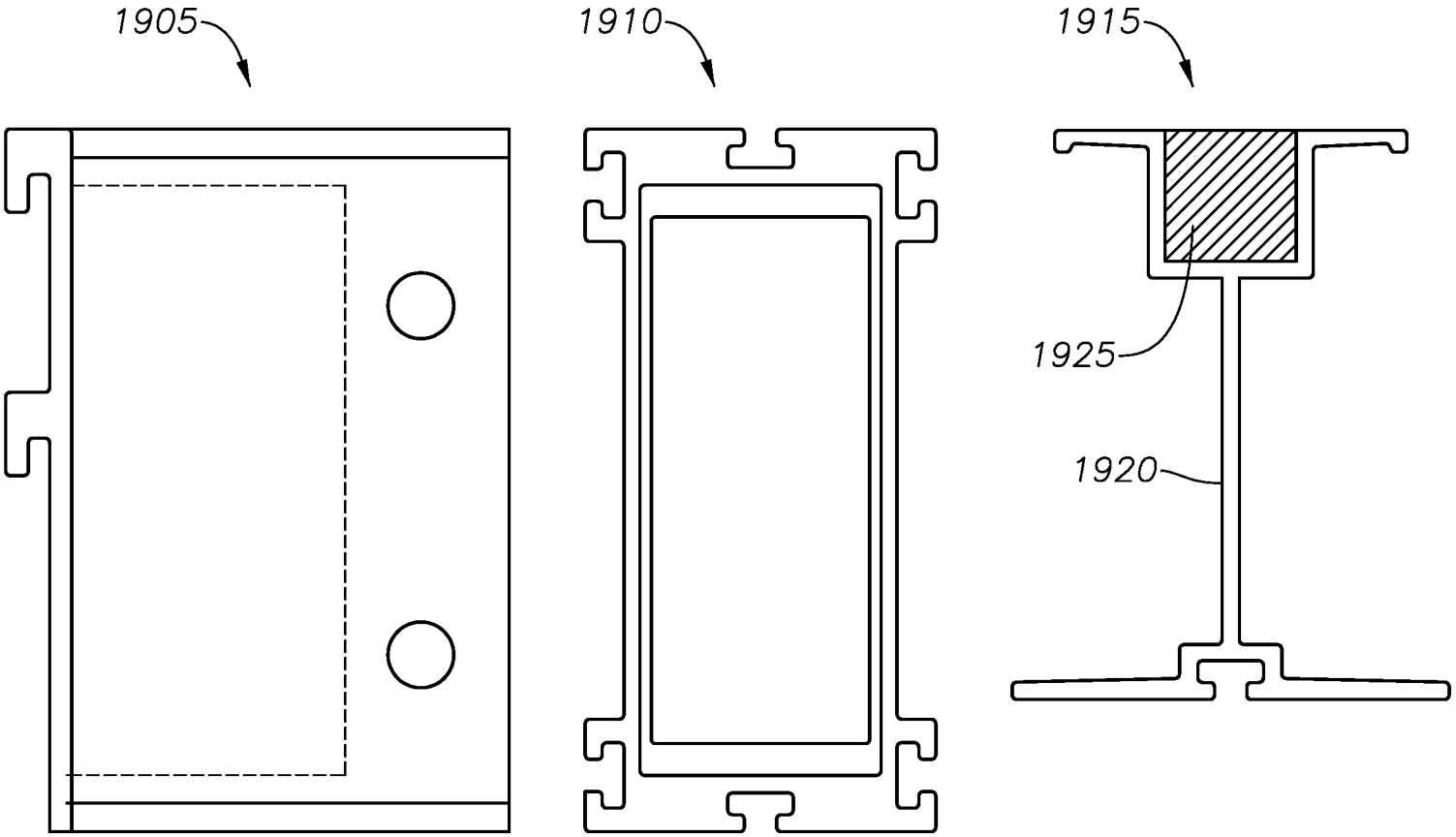
FIG. 19 illustrates beam and joist components in accordance with implementations of various techniques described herein.

FIG. 19 shows beam and joist components. FIG. 19 shows a side cutaway view 1905 of a modular header connector fitting. FIG. 19 also shows a front/rear view 1910 of a header extrusion, e.g., header beam. FIG. 19 further shows a view 1915 of a joist 1920 with a synthetic nailer 1925.

Figure 20:
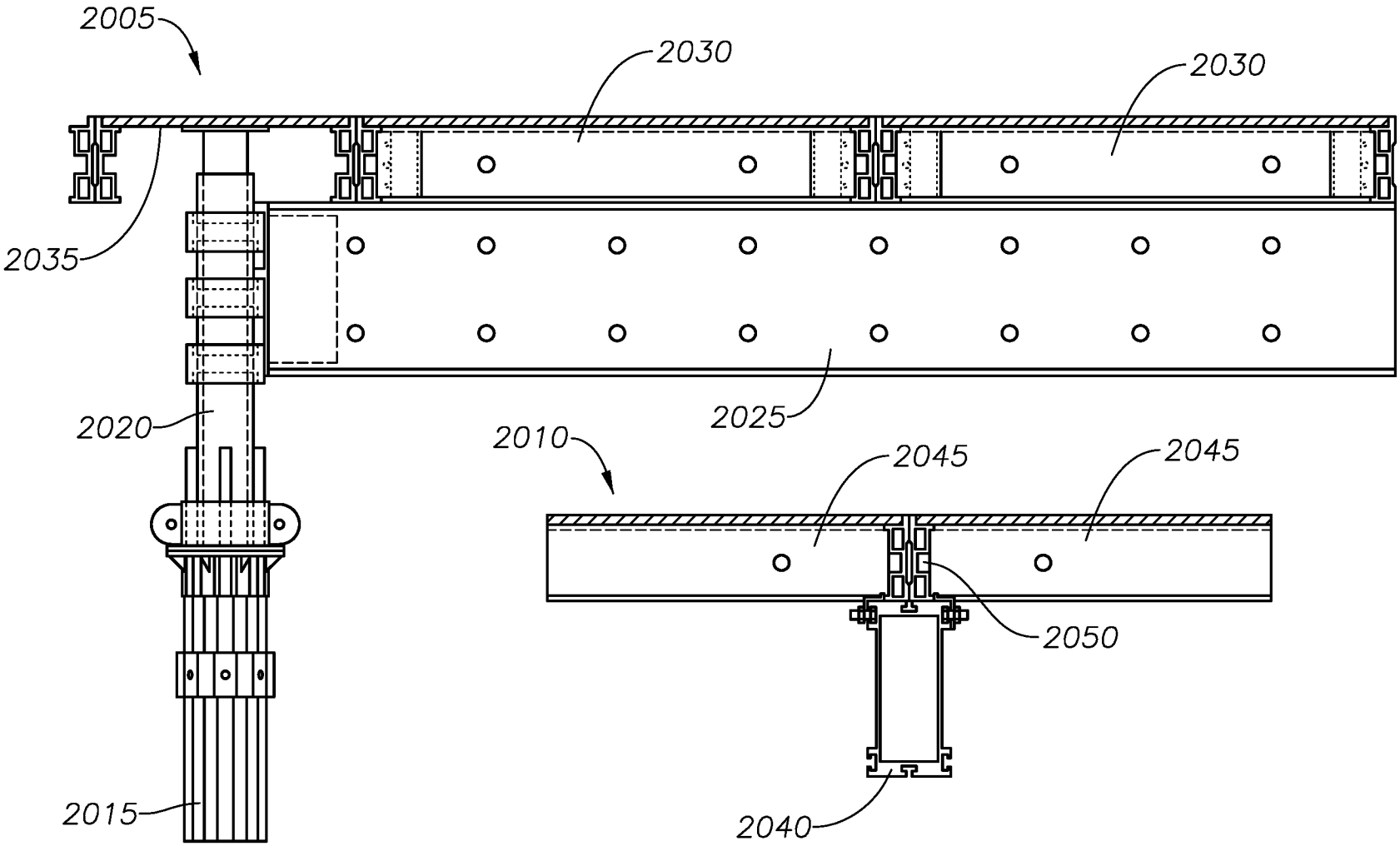
FIG. 20 illustrates modular shoring using standard panel decking in accordance with implementations of various techniques described herein.

FIG. 20 shows modular shoring using standard panel decking. Item 2005 is a side view of a shoring configuration that uses a post 2015, deck drop head assembly 2020, and a modular header beam 2025 to support standard aluminum form panels 2030 and plywood filler 2035 in a shoring application. The standard aluminum form panels 2030 are useable for both formwork and shoring applications. View 2010 is a view in a span direction of the modular header beam 2040 holding up standard aluminum panels 2045. A form alignment plate 2050 is used to connect the modular header beam 2040 to the standard panels.

Figure 21:
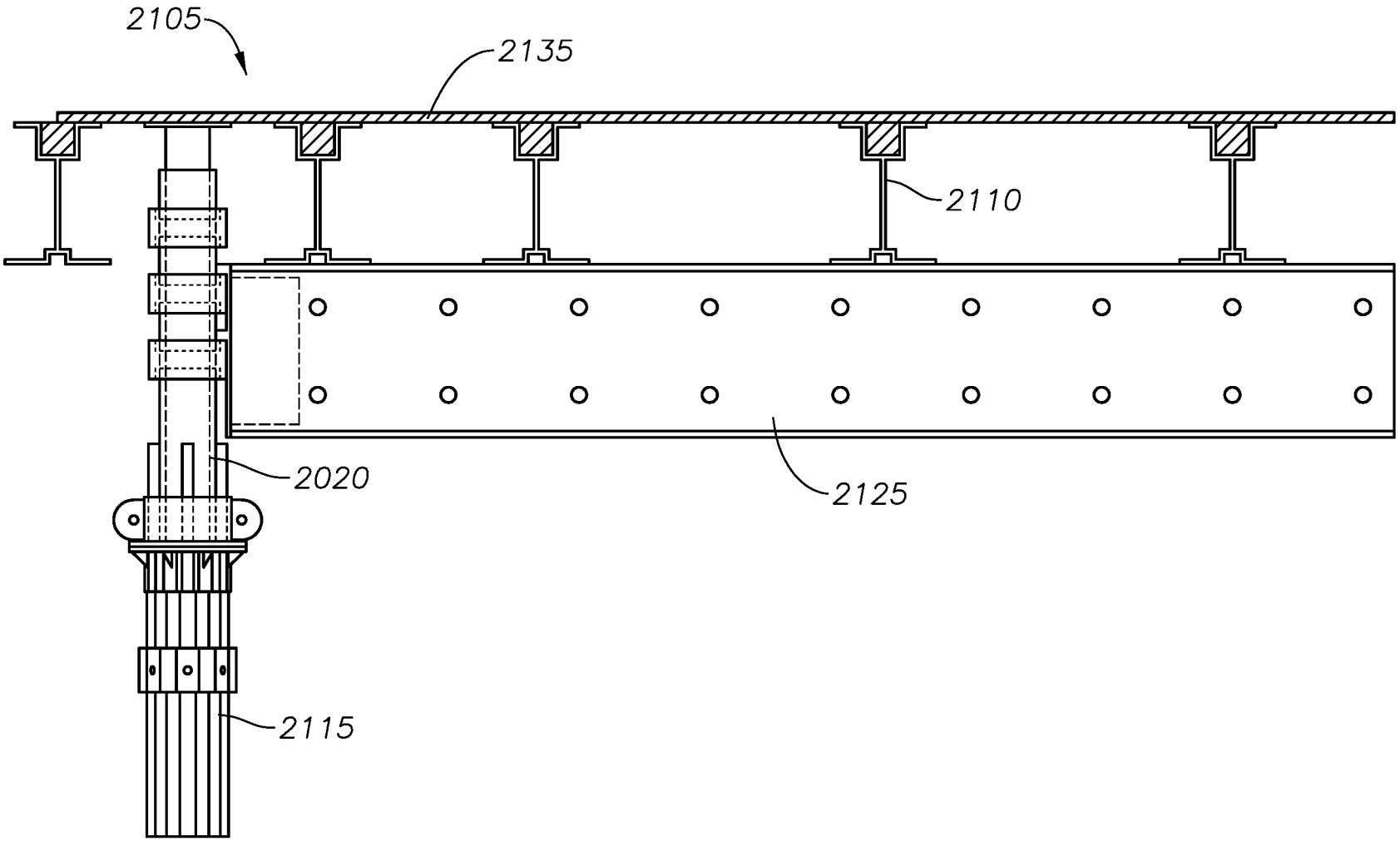
FIG. 21 illustrates modular shoring using standard joist decking in accordance with implementations of various techniques described herein.

FIG. 21 shows modular shoring using standard joist decking. Item 2105 is a side view of a shoring configuration that uses a post 2115, deck drop assembly 2120, and a modular header beam 2125 to support joists 2110 holding up plywood deck material 2135.

Figure 22:
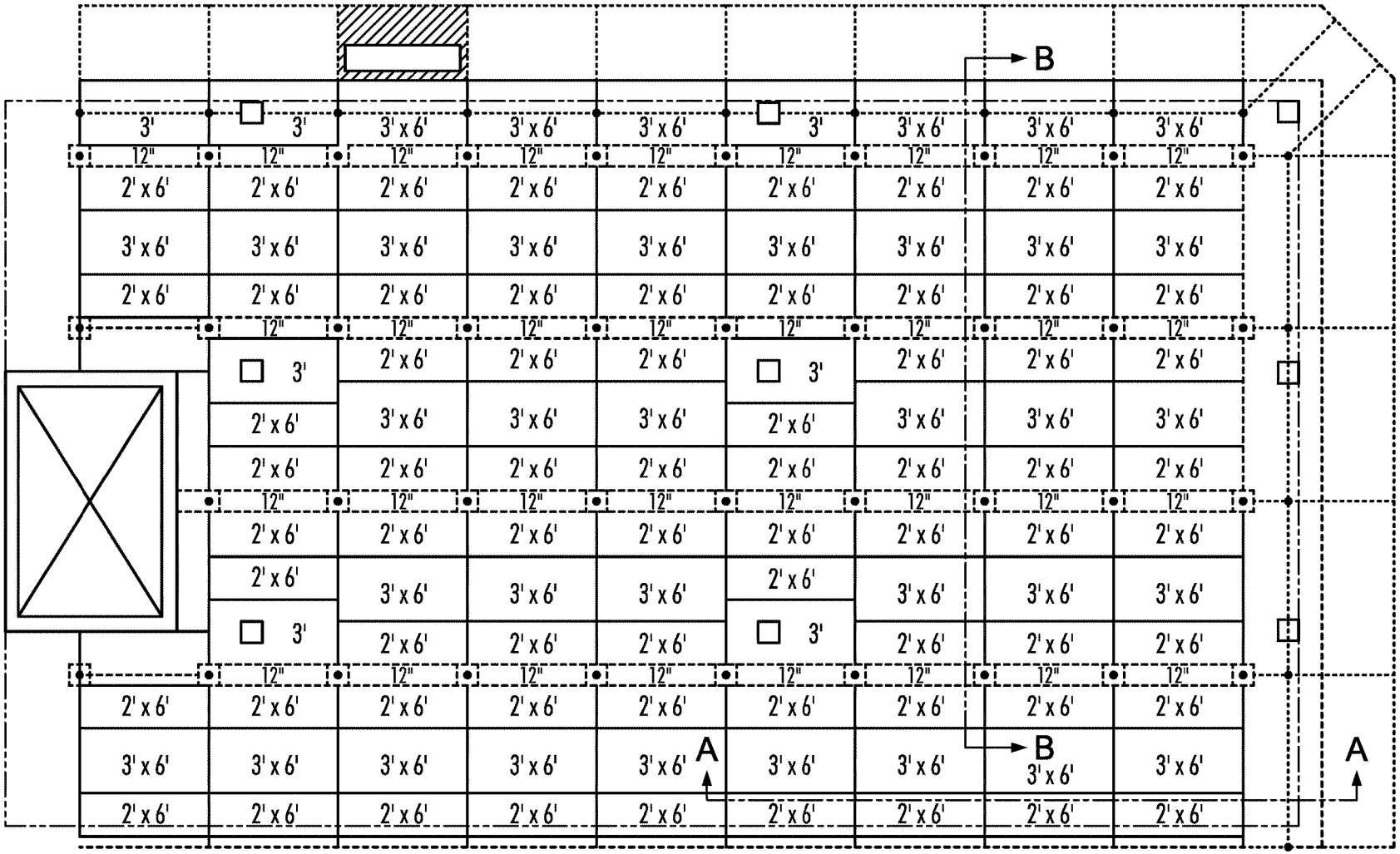
FIG. 22 illustrates a modular shoring plan where standard aluminum panels and filler are used to provide shoring in accordance with implementations of various techniques described herein.

FIG. 22 shows an implementation of a modular shoring plan of an integrated construction system where standard aluminum panels and filler are used to provide shoring. Although any of the standard aluminum panels can be used in a shoring application, this implementation shows 2×6 and 3×6 panels being used to provide shoring for a horizontal concrete slab. In addition, different sized filler panels can be added as needed. FIG. 22 shows 12 inch and 3 foot panels. Panels in prior art shoring systems are only designed for deck slabs. Prior art shoring panels were not used for columns, walls, etc. The present integrated construction system uses panels that can be used vertically for formwork and horizontally for shoring applications. FIG. 22 also shows a perimeter safety deck. The integrated construction system includes components that may be used interchangeably in formwork, shoring and/or worker access configurations. Different views of the standard aluminum panels being supported by components of the integrated construction system are described below with respect to FIG. 23. The views described below are denoted by an A-A view, which provides a view in a first direction relative to the shoring application and a B-B view, which provides a view in a second direction relative to the shoring application.

Figure 23:
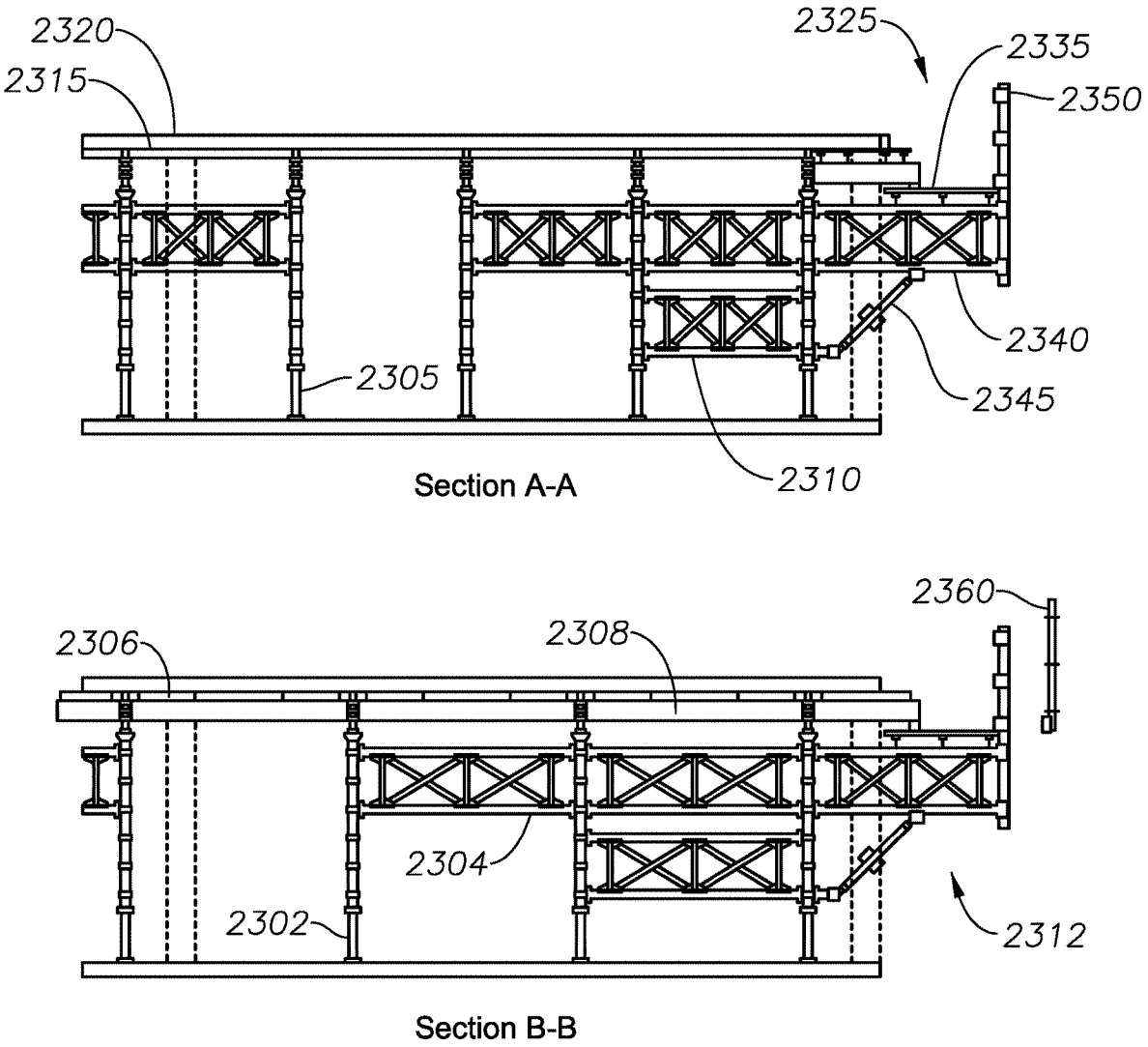
FIG. 23 illustrates modular shoring sections and details in accordance with implementations of various techniques described herein.
Figure 23:
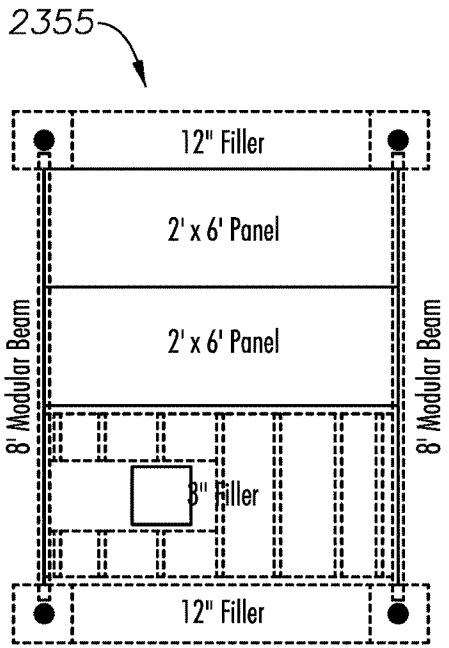

FIG. 23 shows an implementation of modular shoring sections and details. Section A-A is a side view of the shoring support structure. In this view, various posts 2305 and bracing assemblies 2310 are used to support standard aluminum panels 2315 holding up a poured concrete slab 2320. In addition, a perimeter safety deck 2325 is formed from a bracing assembly 2340, joists 2335, a ledger rail 2350 and a bracing element 2345. Section B-B is a view from a different side showing the posts 2302, bracing assemblies 2304, standard aluminum panels 2306, header beams 2308, and the perimeter safety deck 2312. In one implementation, the perimeter safety deck uses an optional pinlock guardrail 2360. FIG. 23 further shows, in greater detail, a view 2355 of a column area of the example shoring deck. This implementation illustrates how to use standard aluminum form panels for both vertical and horizontal applications. In addition, this implementation may be used in a drop deck shoring application.

Figure 24:
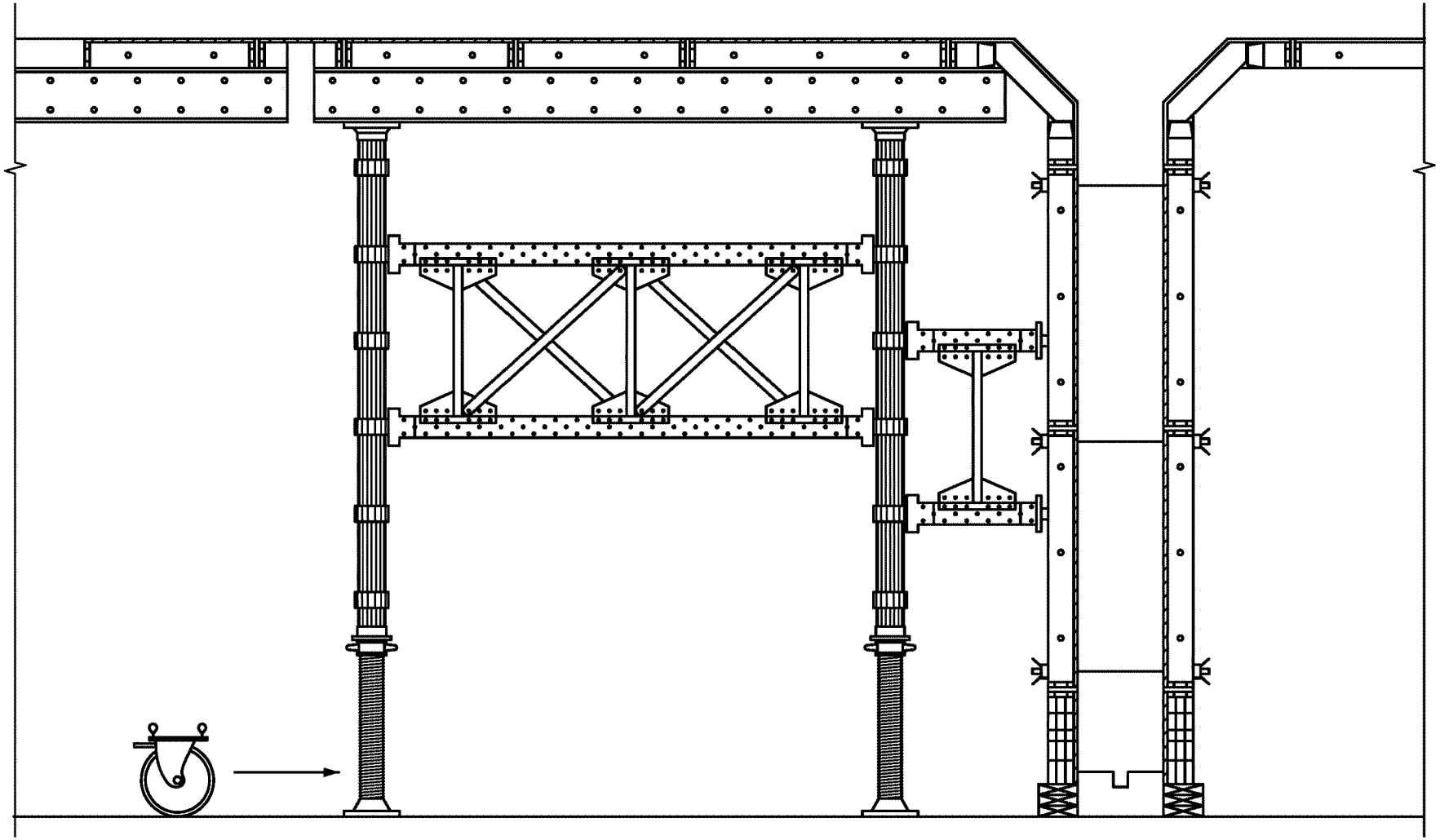
FIG. 24 illustrates various components of the integrated construction system being used together to form a tunnel form in accordance with implementations of various techniques described herein.

FIG. 24 shows various components of the integrated construction system being used together to form a tunnel form. In this implementation, the aluminum form panels are used in a hybrid application where both a formwork and a shoring configuration are used to create the tunnel form. Tunnel form applications can be used to provide an underground culvert, e.g., under a road, that water flows through.

Figure 25:
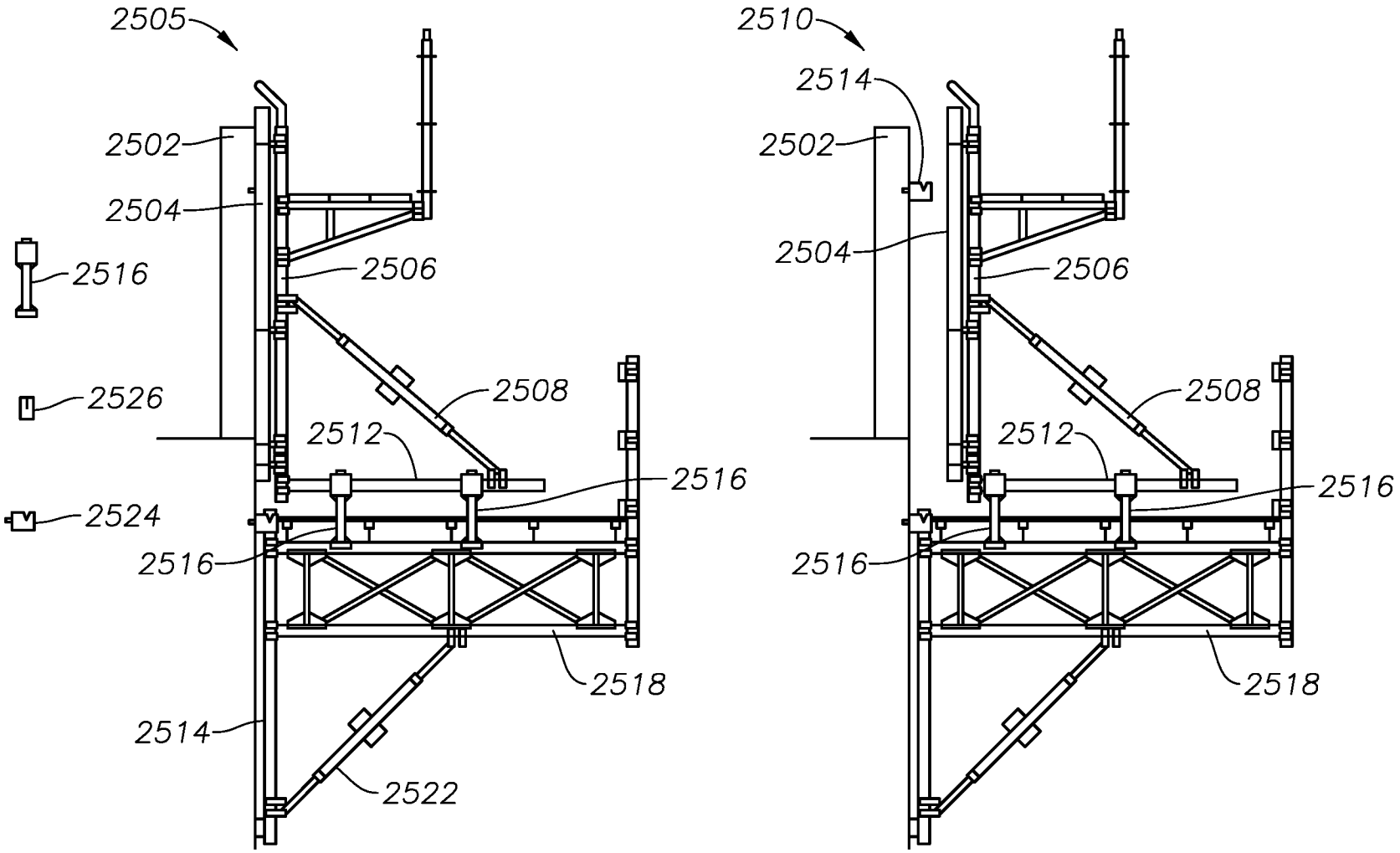
FIG. 25 illustrates a rollback shearwall deck in accordance with implementations of various techniques described herein.

FIG. 25 shows two views that show a rollback shearwall deck. In view 2505, the rollback mechanism is shown in a set position, i.e., adjacent to the concrete wall 2502. The rollback mechanism includes one or more standard panels 2504, at least one first vertical ledger rail 2506 coupled to at least one horizontal ledger rail 2512 and supported by brace 2508. The one or more horizontal ledger rails are coupled to a bracing assembly 2518 by a rollback strut 2516. The bracing assembly 2518 is coupled to at least one second vertical ledger rail 2514 and supported by brace 2522. In view 2510, the rollback mechanism is shown in a fly position, i.e., pulled back from the concrete wall. In the fly position, elements 2504, 2506, 2508, 2512, 2516 are moved laterally along bracing assembly 2518 from the set position to the fly position. The implementation shown in FIG. 25 provides a rollback shear wall deck system and worker access platform application. Ledger panels are used to provide this rollback mechanism in both vertical and horizontal configurations. FIG. 25 also shows landing bracket A 2524 and landing bracket B 2526.

FIG. 25 illustrates another example of using an integrated construction system to provide both formwork and shoring to form an exterior shearwall, for example, those typically found on high rise buildings. The wall form and platform are assembled as a unit to allow worker access outside of the building limits at elevation The wall form and work platform can be picked up with a crane as a unit and landed onto a bracket at the next elevation. The wall form and work platform also allow the crane rigging to be released safely by the construction workers. The crane rigging is released more safely because the form panel seats itself onto the bracket securely and uses gravity to hold it in-place without human interaction. This allows the workers to access the platform safely to remove the rigging and complete the next wall pour.

Figure 26:
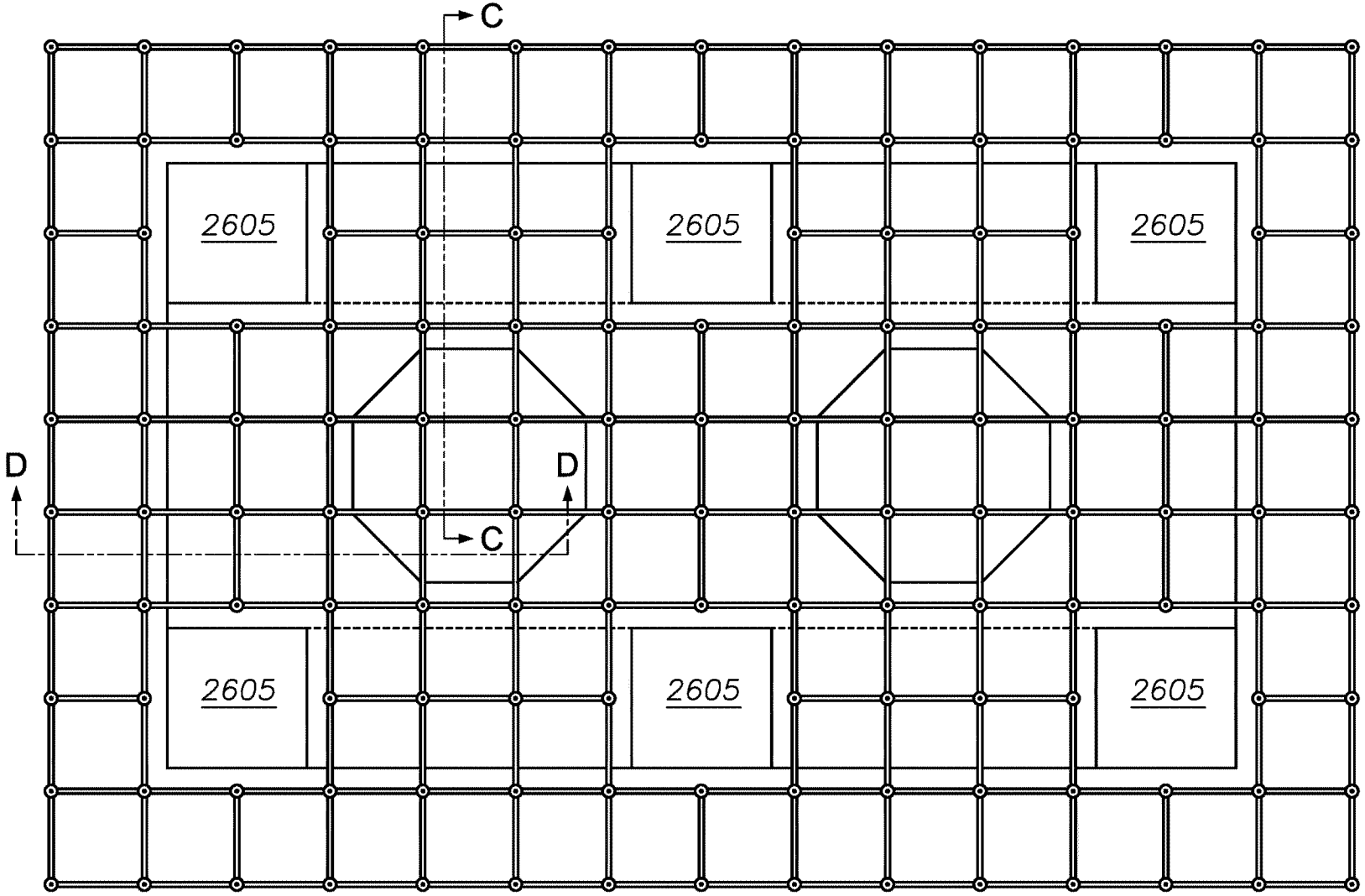
FIG. 26 illustrates a plan view of the HD shoring application in accordance with implementations of various techniques described herein.
Figure 27:
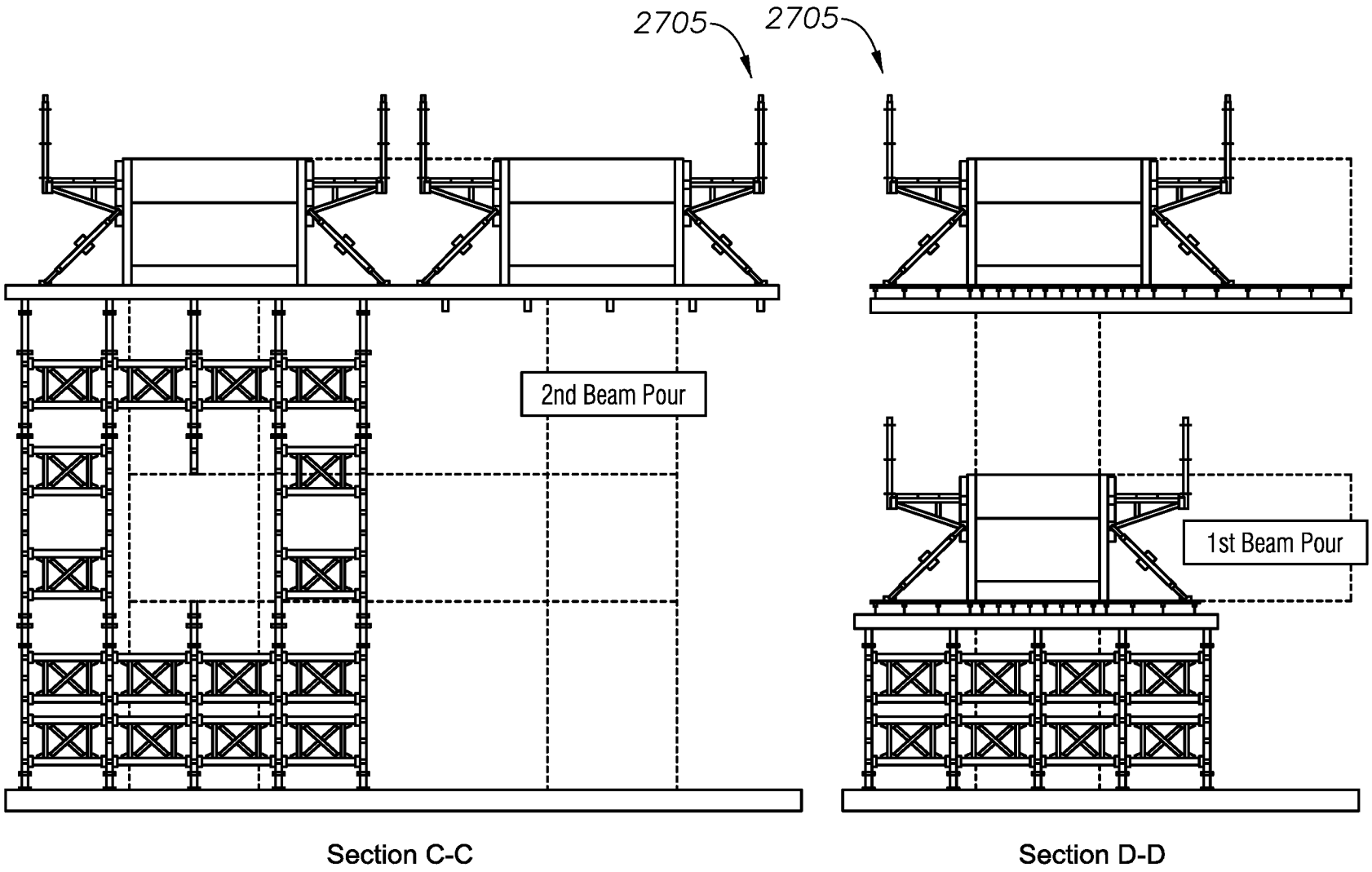
FIG. 27 illustrates an elevational view of the HD shoring application in accordance with implementations of various techniques described herein.

FIG. 26 and FIG. 27 show an industrial heavy duty (HD) shoring application. In particular FIG. 26 shows a plan view of the HD shoring application and FIG. 27 shows an elevational view of the HD shoring application. The configuration described in FIGS. 26 and 27 is used to create vertical columns and horizontal beams. In particular, FIG. 26 illustrates columns 2605 upon which a next layer of horizontal beams are to be placed. Views C-C and D-D show formwork and shoring for a 2nd beam and a 1st beam, respectively. Also shown in FIG. 27 are worker access platforms 2705.

Figure 28:
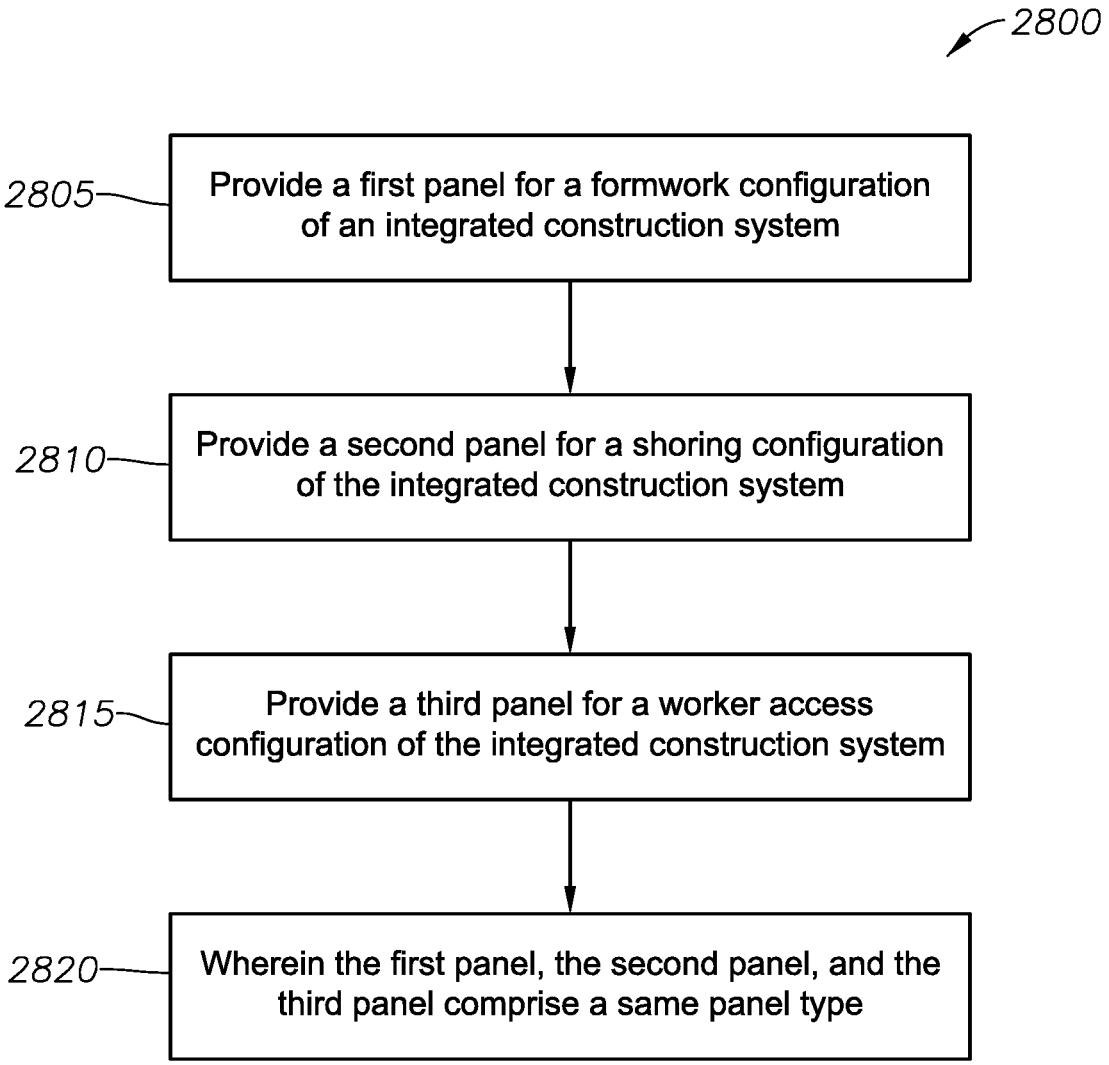
FIG. 28 illustrates a block diagram of a method of providing an integrated construction system in accordance with implementations of various techniques described herein.

FIG. 28 illustrates a block diagram of a method 2800 of providing an integrated construction system. At block 2805, a first panel for a formwork configuration of an integrated construction system is provided. At block 2810, a second panel for a shoring configuration of the integrated construction system is provided. At block 2815, a third panel for a worker access configuration of the integrated construction system is provided. The first panel, the second panel, and the third panel are a same panel type, e.g., modular ledger or standard aluminum panel (form panel).

In one implementation, the posts are all aluminum. The fittings may be cast steel or cast aluminum. With respect to the bracing assembly, the ledger panels are made of aluminum. The end fittings with the screw mechanism may be steel. The vertical struts may be steel. The cross brace may be an aluminum strap. In this manner, the bracing assembly can be a combination of aluminum and steel. The present shoring system does not use any welded aluminum.

The present shoring system includes a number of advantages and benefits. The present shoring system is part of a larger integrated construction system that provides a total solution for formwork, shoring and heavy-duty access. This new larger integrated construction system has significantly less items in its usable inventory, as compared to other independent task focused systems, i.e., prior art independent formwork systems, prior art independent shoring systems, and prior art independent heavy-duty access systems. The present integrated construction system has a unique approach to the type of materials used in its construction, as well as the method of manufacture. The present integrated construction system, by design, minimizes the number of separate components needed to provide shoring, formwork and worker access application. The integrated construction system further provides a unique method of manufacturing the integrated construction system components.

The integration of formwork, shoring and heavy-duty access into one system creates a unique and singular approach for providing a "construction system" vs. individual systems that are designed to handle one of the three applications. The present integrated construction system reduces the amount of inventoried components by over 75%, as compared to existing systems. In addition, this unique combination of components provides new innovative methods to construction worker access that is currently not available on elevated construction sites.

In combination with the robust nature of the materials of the integrated construction system and the method of assembly, the cost to own the present integrated construction system is vastly reduced for both a dead asset basis, as well as the physical maintenance cost required to maintain a formwork and access inventory. In addition, the integrated construction system provides an increased flexibility to handle field applications, as well as increase the efficiency for the contractors that will use the integrated construction system to build concrete structures.

The discussion above is directed to certain specific implementations. It is to be understood that the discussion above is only {XE "Narrowing designation: only"} for the purpose of enabling a person with ordinary skill in the art to make and use any subject matter defined now or later by the patent "claims" found in any issued patent herein.

It is specifically intended that the claimed invention {XE "Narrowing designation: invention"} not be limited to the implementations and illustrations contained herein, but include modified forms of those implementations including portions of the implementations and combinations of elements of different implementations as come within the scope of the following claims. It should be appreciated that in the development of any such actual implementation, as in any engineering or design project, numerous implementation-specific decisions may be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Nothing in this application is considered critical {XE "Narrowing designation: critical"} or essential {XE "Narrowing designation: essential"} to the claimed invention unless explicitly indicated as being "critical" or "essential."

In the above detailed description, numerous specific details were set forth in order to provide a thorough understanding of the present disclosure. However, it will be apparent to one of ordinary skill in the art that the present disclosure may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only {XE "Narrowing designation: only"} used to distinguish one element from another. For example, a first object or step could be termed a second object or step, and, similarly, a second object or step could be termed a first object or step, without departing from the scope of the invention {XE "Narrowing designation: invention"}. The first object or step, and the second object or step, are both objects or steps, respectively, but they are not to be considered the same object or step.

The terminology used in the description of the present disclosure herein is for the purpose of describing particular implementations only and is not intended to be limiting of the present disclosure. As used in the description of the present disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. As used herein, the terms "up" and "down"; "upper" and "lower"; "upwardly" and downwardly"; "below" and "above"; and other similar terms indicating relative positions above or below a given point or element may be used in connection with some implementations of various technologies described herein.

While the foregoing is directed to implementations of various techniques described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily {XE "Narrowing designation: necessarily"} limited to the specific features or acts described above. Rather, the specific features and acts described above are disclosed as example forms of implementing the claims.

What is claimed is:

1. A modular ledger of an integrated construction system, comprising:

a rail, having: a first end and a second end, each end configured to be coupled to one or more posts and/or assemblies through a coupling component; and a plurality of rows of holes spaced longitudinally along each side of the rail from about the first end to about the second end and configured to couple to bracing components of the integrated construction system;

wherein the rail is hollow, and wherein the rail enables the integrated construction system to support a load of 100,000 pounds in a shoring application, in a formwork application and in a scaffolding application.

2. The modular ledger of claim 1, wherein the rail is constructed of aluminum.

3. The modular ledger of claim 1, wherein the coupling component comprises a ledger clamp.

4. The modular ledger of claim 1, wherein the coupling component comprises a ledger splice.

5. The modular ledger of claim 1, wherein the coupling component comprises a ledger guardrail fitting.

6. The modular ledger of claim 1, wherein the coupling component comprises a ledger end fitting.

7. The modular ledger of claim 1, wherein the plurality of rows of holes comprise a hole pattern formed longitudinally along each side of the rail.

8. The modular ledger of claim 1, wherein the rail is configured to form a wall of a safety deck.

9. The modular ledger of claim 1, wherein the rail is configured to form part of a rollback mechanism.

10. The modular ledger of claim 1, wherein the rail is configured to form part of a bracing assembly when coupled to the bracing components.

11. The modular ledger of claim 1, wherein the rail is configured as a load bearing member when coupled to the posts of the integrated construction system.

12. An integrated construction system component, comprising:

a ledger rail:

constructed of aluminum;

having a plurality of rows of holes placed longitudinally along each side of an entire length of the ledger rail from about a first end of the ledger rail to about a second end of the ledger rail; and configured to:

be coupled to one or more bracing components via the plurality of holes;

be coupled to one or more posts and/or assemblies through one or more coupling components; and handle vertical loads while attached to other components of the integrated construction system;

wherein the ledger rail is hollow, and wherein the ledger rail enables an integrated construction system to support a load of 100,000 pounds in a shoring application, in a formwork application and in a scaffolding application.

13. The integrated construction system component of claim 12, wherein the ledger rail is coupled in parallel to another ledger rail via the one or more bracing components.

14. The integrated construction system component of claim 13, wherein the one or more bracing components comprise at least one strut.

15. The integrated construction system component of claim 13, wherein a load capacity of the ledger rail can be adjusted by adding or removing bracing components.

16. The integrated construction system component of claim 12, wherein the ledger rail is coupled between two of the one or more posts via the one or more coupling components.

17. The integrated construction system component of claim 12, wherein the ledger rail is coupled to another ledger rail via the one or more coupling components.

18. The integrated construction system component of claim 12, wherein the other components comprise other ledger rails, other posts or other assemblies of the integrated construction system.

19. The integrated construction system component of claim 12, wherein the one or more coupling components comprise at least one of a ledger clamp, a ledger splice, a ledger guardrail fitting, and a ledger end fitting.

20. The integrated construction system component of claim 12, wherein the plurality of rows of holes are punched into the ledger rail.

* * * * *